US008693907B2

(12) United States Patent
Fowlkes et al.

(10) Patent No.: US 8,693,907 B2
(45) **Date of Patent: *Apr. 8, 2014**

(54) DUAL TONER PRINTING WITH DISCHARGE AREA DEVELOPMENT

(75) Inventors: William Yurich Fowlkes, Pittsford, NY (US); Donald Saul Rimai, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 164 days.

This patent is subject to a terminal disclaimer.

(21) Appl. No.: 13/077,496

(22) Filed: Mar. 31, 2011

(65) Prior Publication Data

US 2012/0251144 A1 Oct. 4, 2012

(51) Int. Cl.
*G03G 15/08* (2006.01)

(52) U.S. Cl.
USPC ..... 399/53

(58) Field of Classification Search
CPC ..... G03G 15/02
See application file for complete search history.

(56) References Cited

U.S. PATENT DOCUMENTS

| | | | | |
|---|---|---|---|---|
| 3,724,422 | A | 4/1973 | Latone et al. | |
| 3,927,641 | A | 12/1975 | Handa | |
| 4,041,903 | A | 8/1977 | Katakura et al. | |
| 4,416,533 | A * | 11/1983 | Tokunaga et al. | 347/118 |
| 5,234,783 | A | 8/1993 | Ng | |
| 5,837,406 | A * | 11/1998 | Tavernier et al. | 430/12 |
| 5,905,012 | A | 5/1999 | De Meutter et al. | |
| 5,926,679 | A | 7/1999 | May et al. | |
| 6,608,987 | B2 | 8/2003 | Bartscher et al. | |
| 6,880,463 | B2 | 4/2005 | DeMeulemeester et al. | |
| 7,016,621 | B1 | 3/2006 | Ng | |
| 7,120,379 | B2 | 10/2006 | Eck et al. | |
| 7,218,881 | B2 * | 5/2007 | Tanaka | 399/269 |
| 7,389,073 | B2 | 6/2008 | Kamar et al. | |

(Continued)

FOREIGN PATENT DOCUMENTS

| | | | | |
|---|---|---|---|---|
| JP | 62-049377 | | 3/1987 | |
| JP | 03028865 | A * | 2/1991 | G03G 15/01 |

(Continued)

OTHER PUBLICATIONS

IS & T's 1997 International Conference on Digital Printing Technologies, UV-cured Toners for Printing and Coating on Paper-like Substrates, pp. 168-172, Detlef Schuzle-Hagenest, Micheal Huber, Saskia Udding-Louwrier and Paul H.G. Binda.

*Primary Examiner* — Clayton E Laballe
*Assistant Examiner* — Victor Verbitsky
(74) *Attorney, Agent, or Firm* — David A. Novais

(57) ABSTRACT

Methods for printing are provided. In one aspect a primary imaging member having a pattern of engine pixel locations with image modulated differences of potential and with first toner having a first toner difference of potential is moved to a second development station. A second development difference of potential of the first polarity at the second development station forms a second net development difference of the second development difference of potential less any image modulated difference of potential at the individual engine pixel location and less any difference of potential relative to ground of any first toner at the individual engine pixel location. The second development difference of potential is greater than the first development difference of potential so that second toner that is different from the first toner, is developed onto the first toner using the second net development difference of potential.

21 Claims, 16 Drawing Sheets

(56) References Cited

U.S. PATENT DOCUMENTS

| | | | | |
|---|---|---|---|---|
| 2002/0168200 | A1 | 11/2002 | Stelter et al. | |
| 2008/0152389 | A1* | 6/2008 | Kim | 399/223 |
| 2008/0152391 | A1* | 6/2008 | Bae et al. | 399/231 |
| 2009/0162113 | A1 | 6/2009 | Solcz et al. | |
| 2009/0297970 | A1* | 12/2009 | Tyagi et al. | 430/66 |
| 2010/0092215 | A1* | 4/2010 | Veregin et al. | 399/223 |

FOREIGN PATENT DOCUMENTS

| | | |
|---|---|---|
| JP | 2000-231279 | 8/2000 |
| JP | 2005-189719 | 7/2005 |
| JP | 2007-328061 | 12/2007 |

* cited by examiner

DUAL TONER PRINTING WITH DISCHARGE AREA DEVELOPMENT

CROSS REFERENCE TO RELATED APPLICATIONS

This application relates to commonly assigned, copending U.S. application Ser. No. 13/077,543, filed Mar. 31, 2013, entitled: "RATIO MODULATED PRINTING WITH DISCHARGE AREA DEVELOPMENT"; U.S. application Ser. No. 13/077,474, filed Mar. 31, 2013, entitled: "DUAL TONER PRINTING WITH CHARGE AREA DEVELOPMENT"; U.S. application Ser. No. 13/077,522, filed Mar. 31, 2011, entitled: "RATIO MODULATED PRINTING WITH CHARGE AREA DEVELOPMENT"; U.S. application Ser. No. 13/018,188, filed Jan. 31, 2011, entitled: "ENHANCEMENT OF DISCHARGED AREA DEVELOPED TONER LAYER"; U.S. application Ser. No. 13/018,158, filed Jan. 31, 2011, entitled: "ENHANCEMENT OF CHARGE AREA DEVELOPED TONER LAYER"; U.S. application Ser. No. 13/018,172, filed Jan. 31, 2011, entitled: "BALANCING DISCHARGE AREA DEVELOPED AND TRANSFERRED TONER"; U.S. application Ser. No. 13/018,148, filed Jan. 31, 2011, entitled: "BALANCING CHARGE AREA DEVELOPED AND TRANSFERRED TONER"; U.S. application Ser. No. 13/018,183, filed Jan. 31, 2011, entitled: "PRINTER WITH DISCHARGE AREA DEVELOPED TONER BALANCING"; and U.S. application Ser. No. 13/018,136, filed Jan. 31, 2011, entitled: "PRINTER WITH CHARGE AREA DEVELOPED TONER BALANCING"; each of which is hereby incorporated by reference.

FIELD OF THE INVENTION

This invention pertains to the field of printing.

BACKGROUND OF THE INVENTION

Color electrophotographic printers provide full color images by building up and sequentially transferring individual color separation toner images in registration onto a receiver and fusing the toner and receiver. Specific color outcomes are achieved in such printers by providing toner images of specific colors that, when assembled in registration with toner images having other specific colors form precise combinations of differently colored toners that have the appearance of a desired color at specific locations on a receiver. Similarly, the gloss of such electrophotographically produced color toner images can be enhanced by combining a toner image formed using a toner that will be generally transparent after fusing in registration with the color toner image to provide a layer of toner having a consistent index of refraction and optionally reduced surface roughness.

It will be appreciated that many desirable printing outcomes can be achieved through controlled combinations of different toner types. However, a central limitation on the use of multiple different toner types in electrophotographic printers and methods is that electrophotographic printing modules of the type that form the individual toner images can be large, complicated and expensive. Further, it is difficult to ensure registration of the printing modules with the transfer systems and receivers in a digital printer and such difficulties increase with each additional printing module that is to be incorporated into a printer.

Accordingly, printers are typically designed to provide a limited number of such electrophotographic printing modules. For example, the Nexpress 2100 and subsequent models provide a tandem arrangement of five printing modules. During printing of a color image four of these tandem printing modules apply different ones of four toners, each supplying one of the four primary subtractive colors, while a fifth printing module is used to apply custom colors, clear overcoats and other different types of toner to the formed toner image. While this can be done in a highly effective and commercially viable manner, there remains a need in the art for methods that enable toner images to be formed for use in making an electrophotographic print that include a greater number of different toners than the limited number that are currently available and that can provide such toners in controlled registration and in an image modulated manner.

In one alternative, U.S. Pat. No. 5,926,679, issued to May, et al., discloses that a clear (non-marking) toner layer can be laid down on a photoconductive member (e.g., imaging cylinder) prior to forming a marking particle toner image thereon, and that a clear toner layer can be laid down as a last layer on top of a marking particle toner image prior to transfer of the image to an intermediate transfer member (e.g., blanket cylinder). It is also disclosed that a clear toner layer can be laid down on a blanket cylinder prior to transferring a marking particle toner image from a photoconductive member. In one aspect of this patent, a non-imagewise clear toner layer is bias-developed on to an intermediate transfer member using a uniform charger and a non-marking toner development station. A first monocolor toner image corresponding to one of the marking toners is transferred to the ITM (on top of the clear toner) from a primary imaging member which may be a roller or a web but is preferably a roller. Subsequently, a second monocolor toner image corresponding to another of the marking toners is transferred to the ITM (on top of and in registration with the first toner image) and so forth until a completed multicolor image stack has been transferred on top of the clear toner on the ITM. The ITM is then positioned at a sintering exposure station; where a sintering radiation is turned on to sinter the toner image for a predetermined length of time.

However, while this approach can be effective and can provide a commercially viable solution, this approach requires an additional transfer step for each toner that is applied which, in turn, reduces machine productivity.

Accordingly, what is needed in the art are printers and printing methods that enable an increase in the number of toner types that can be provided to form a color toner image without compromising the efficiency and the accuracy of registration with which each of the toners can be provided.

SUMMARY OF THE INVENTION

Methods for printing are provided. In one aspect of a method of printing, selected engine pixel locations on a primary imaging member are charged with an image modulated difference of potential of a first polarity between a higher potential and a lower potential relative to a ground and a first development difference of potential is established between the higher potential and the lower potential at a first development station to form a first net development difference of potential between the first development station and individual engine pixel locations on the primary imaging member with the first net development potential being the first development difference of potential less any image modulated difference of potential at the engine pixel location. A first toner charged at the first polarity is positioned at the first development station such that the first toner is electrostatically urged to deposit in the individual engine pixel locations according to the first net development difference of potential for the individual engine pixel locations. A second development difference of potential of the first polarity is established at a second development station to form a second net development difference of potential between the second development station and individual engine pixel locations on the primary imaging member, with the second net development difference of potential being the second development difference of potential less any image modulated difference of potential at the individual engine pixel location and less any difference of potential relative to ground of any first toner at the individual engine pixel location. A second toner having a charge of the first polarity is positioned at the second development station such that the second toner is electrostatically urged by the second net development difference of potential to deposit on engine pixel locations having first toner. The second development difference of potential is greater than the first development difference of potential and the first development potential is determined to separate a first range of image modulated differences of potential that will cause image modulated development of the first toner and a second range of image modulated differences of potential that will cause image modulated development of the second toner without development of any first toner.

DETAILED DESCRIPTION OF THE DRAWINGS

Figure 9:
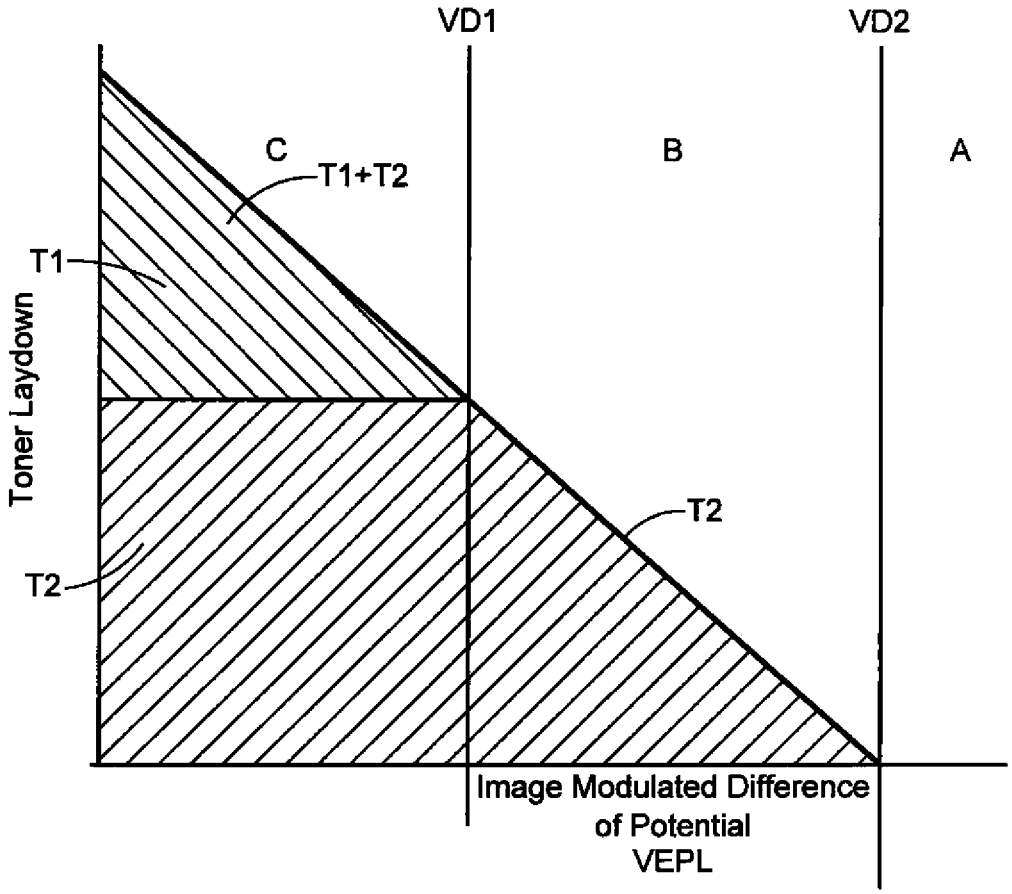

FIG. 9 provides one model of a toner delivery curve.

DETAILED DESCRIPTION OF THE INVENTION

Figure 1:
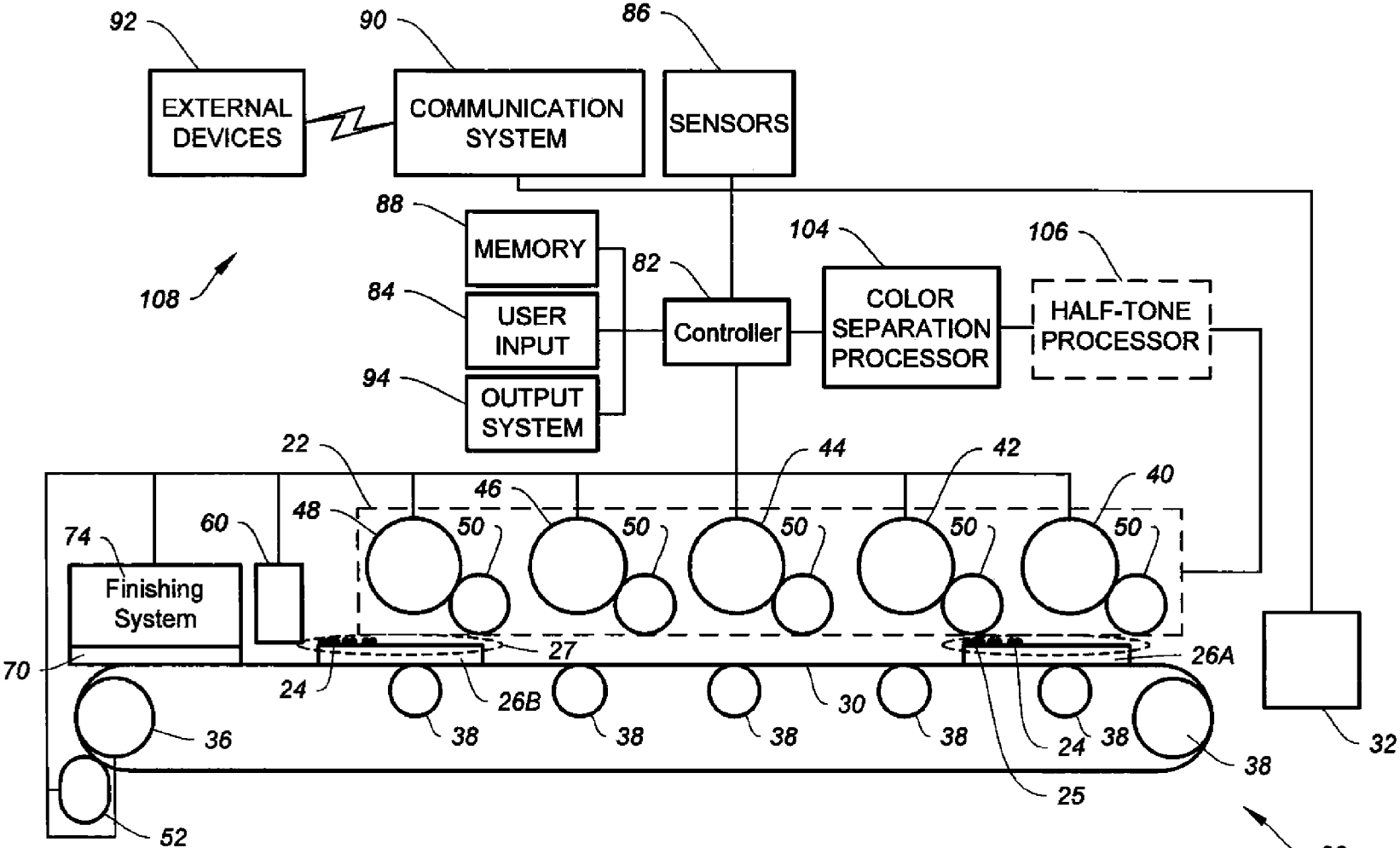
FIG. 1 shows a system level illustration of one embodiment of an electrophotographic printer.
Figure 2:
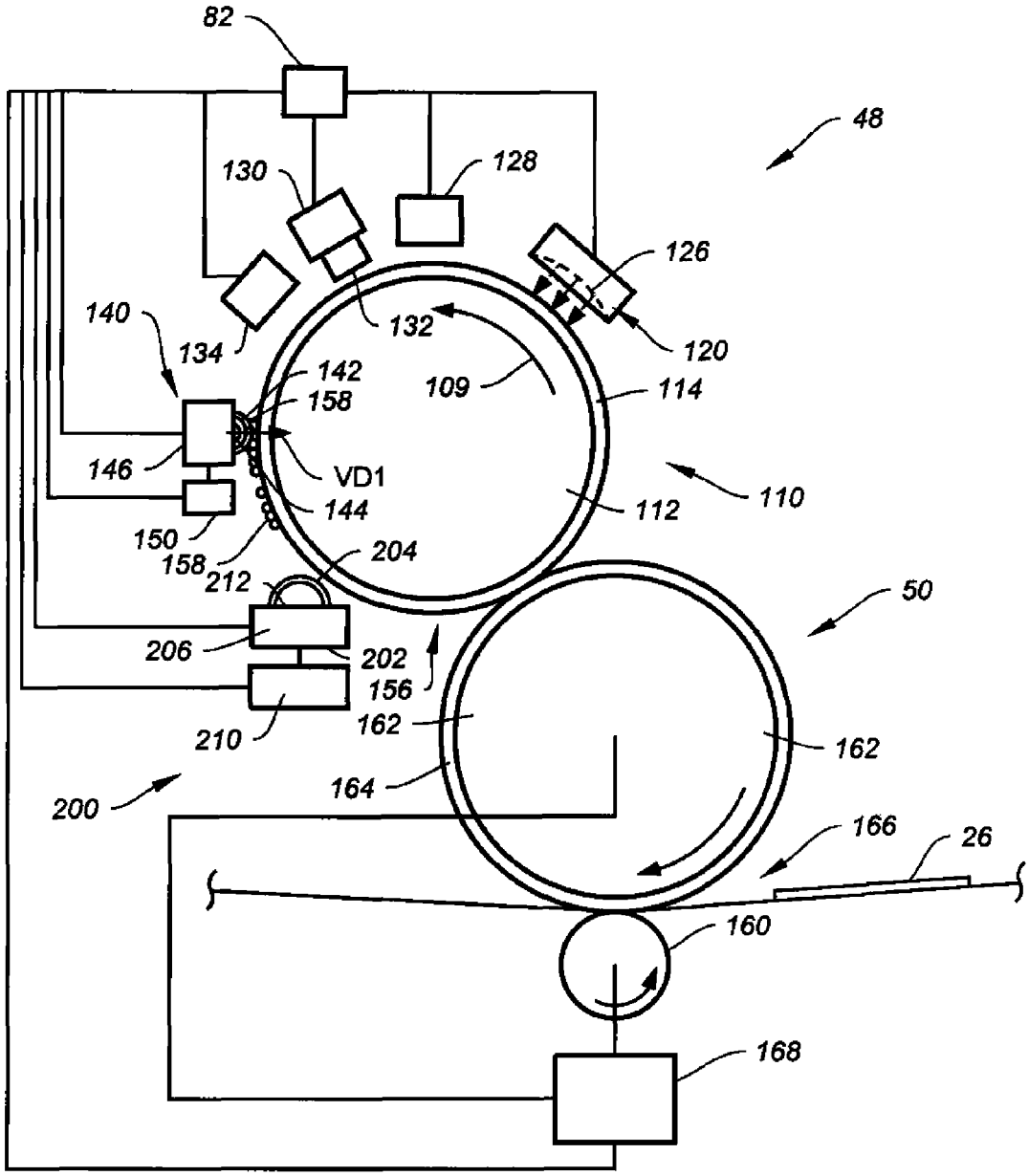
FIG. 2 illustrates one embodiment of a printing module having a toner co-development system during first development.

FIG. 1 is a system level illustration of a printer 20. In the embodiment of FIG. 1, printer 20 has a print engine 22 of an electrophotographic type that deposits toner 24 to form a toner image 25 in the form of a patterned arrangement of toner stacks. Toner image 25 can include any patternwise application of toner 24 and can be mapped according to data representing text, graphics, photo, and other types of visual content, as well as patterns that are determined based upon desirable structural or functional arrangements of the toner 24.

Toner 24 is a material or mixture that contains toner particles and that can form an image, pattern, or indicia when electrostatically deposited on an imaging member including a photoreceptor, photoconductor, electrostatically-charged, or magnetic surface. As used herein, "toner particles" are the particles that are electrostatically transferred by print engine 22 to form a pattern of material on a receiver 26 to convert an electrostatic latent image into a visible image or other pattern of toner 24 on receiver. Toner particles can also include clear particles that have the appearance of being transparent or that while being generally transparent impart a coloration or opacity. Such clear toner particles can provide for example a protective layer on an image or can be used to create other effects and properties on the image. The toner particles are fused or fixed to bind toner 24 to a receiver 26.

Toner particles can have a range of diameters, e.g. less than 4 μm, on the order of 5-15 μm, up to approximately 30 μm, or larger. When referring to particles of toner 24, the toner size or diameter is defined in terms of the median volume weighted diameter as measured by conventional diameter measuring devices such as a Coulter Multisizer, sold by Coulter, Inc. The volume weighted diameter is the sum of the mass of each toner particle multiplied by the diameter of a spherical particle of equal mass and density, divided by the total particle mass. Toner 24 is also referred to in the art as marking particles or dry ink. In certain embodiments, toner 24 can also comprise particles that are entrained in a liquid carrier.

Typically, receiver 26 takes the form of paper, film, fabric, metallicized or metallic sheets or webs. However, receiver 26 can take any number of forms and can comprise, in general, any article or structure that can be moved relative to print engine 22 and processed as described herein.

Figure 3:
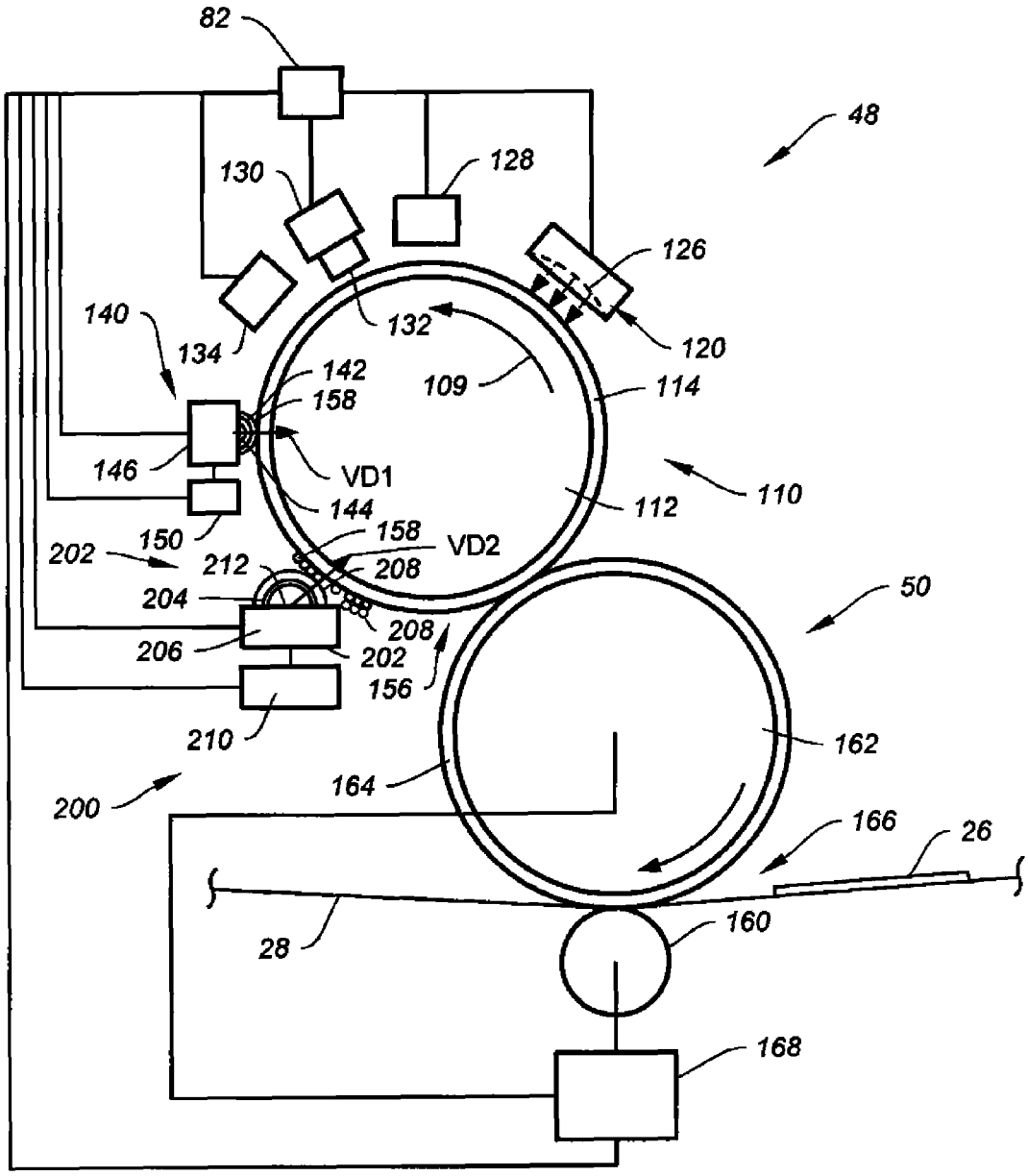
FIG. 3 illustrates the embodiment of FIG. 2 during second development.

Print engine 22 has one or more printing modules, shown in FIG. 3 as printing modules 40, 42, 44, 46, and 48 that are each used to deliver a single application of toner 24 to form a toner image 25 on receiver 26. For example, the toner image 25 shown formed on receiver 26A in FIG. 1 can provide a monochrome image or layer of a structure or other functional material or shape.

Print engine 22 and a receiver transport system 28 cooperate to deliver one or more toner image 25 in registration to form a composite toner image 27 such as the one shown formed in FIG. 1 as being formed on receiver 26B. Composite toner image 27 can be used for any of a plurality of purposes, the most common of which is to provide a printed image with more than one color. For example, in a four color image, four toner images are formed each toner image having one of the four subtractive primary colors, cyan, magenta, yellow, and black. These four color toners can be combined to form a representative spectrum of colors. Similarly, in a five color image various combinations of any of five differently colored toners can be combined to form a color print on receiver 26. That is, any of the five colors of toner 24 can be combined with toner 24 of one or more of the other colors at a particular location on receiver 26 to form a color after a fusing or fixing process that is different than the colors of the toners 24 applied at that location.

In FIG. 1, print engine 22 is illustrated as having an optional arrangement of five printing modules 40, 42, 44, 46, and 48, also known as electrophotographic imaging subsystems arranged along a length of receiver transport system 28. Each printing module delivers a single toner image 25 to a respective transfer subsystem 50 in accordance with a desired pattern. The respective transfer subsystem 50 transfers the toner image 25 onto a receiver 26 as receiver 26 is moved by receiver transport system 28. Receiver transport system 28 comprises a movable surface 30 that positions receiver 26 relative to printing modules 40, 42, 44, 46, and 48. In this embodiment, movable surface 30 is illustrated in the form of an endless belt that is moved by motor 36, that is supported by rollers 38, and that is cleaned by a cleaning mechanism 52. However, in other embodiments receiver transport system 28 can take other forms and can be provided in segments that operate in different ways or that use different structures. In an alternate embodiment, not shown, printing modules 40, 42, 44, 46 and 48 can each deliver a single application of toner 24 to a composite transfer subsystem 50 to form a combination toner image thereon which can be transferred to a receiver.

Printer 20 is operated by a printer controller 82 that controls the operation of print engine 22 including but not limited to each of the respective printing modules 40, 42, 44, 46, and 48, receiver transport system 28, receiver supply 32, and transfer subsystem 50, to cooperate to form toner images 25 in registration on a receiver 26 or an intermediate in order to yield a composite toner image 27 on receiver 26 and to cause fuser 60 to fuse composite toner image 27 on receiver 26 to form a print 70 as described herein or otherwise known in the art.

Printer controller 82 operates printer 20 based upon input signals from a user input system 84, sensors 86, a memory 88 and a communication system 90. User input system 84 can comprise any form of transducer or other device capable of receiving an input from a user and converting this input into a form that can be used by printer controller 82. Sensors 86 can include contact, proximity, electromagnetic, magnetic, or optical sensors and other sensors known in the art that can be used to detect conditions in printer 20 or in the environment-surrounding printer 20 and to convert this information into a form that can be used by printer controller 82 in governing printing, fusing, finishing or other functions.

Memory 88 can comprise any form of conventionally known memory devices including but not limited to optical, magnetic or other movable media as well as semiconductor or other forms of electronic memory. Memory 88 can contain for example and without limitation image data, print order data, printing instructions, suitable tables and control software that can be used by printer controller 82.

Communication system 90 can comprise any form of circuit, system or transducer that can be used to send signals to or receive signals from memory 88 or external devices 92 that are separate from or separable from direct connection with printer controller 82. External devices 92 can comprise any type of electronic system that can generate signals bearing data that may be useful to printer controller 82 in operating printer 20.

Printer 20 further comprises an output system 94, such as a display, audio signal source or tactile signal generator or any other device that can be used to provide human perceptible signals by printer controller 82 to feedback, informational or other purposes.

Printer 20 prints images based upon print order information. Print order information can include image data for printing and printing instructions from a variety of sources. In the embodiment of FIG. 3, these sources include memory 88, communication system 90, that printer 20 can receive such image data through local generation or processing that can be executed at printer 20 using, for example, user input system 84, output system 94 and printer controller 82. Print order information can also be generated by way of remote input and local input and can be calculated by printer controller 82. For convenience, these sources are referred to collectively herein as source of image data 108. It will be appreciated, that this is not limiting and that source of image data 108 can comprise any electronic, magnetic, optical or other system known in the art of printing that can be incorporated into printer 20 or that can cooperate with printer 20 to make print order information or parts thereof available.

In the embodiment of printer 20 that is illustrated in FIG. 1, printer controller 82 has a color separation image processor 104 to convert the image data into color separation images that can be used by printing modules 40-48 of print engine 22 to generate toner images. An optional half-tone processor 106 is also shown that can process the color separation images according to any half-tone screening requirements of print engine 22.

FIGS. 2-5 show more details of an example of a printing module 48 having a dual image modulated toner development system 100. However, it will be appreciated that any or all of printing modules 40, 42, 44, and 46 of FIG. 1 can have such a dual image modulated toner development system 100 and optionally any of the dual image modulated toner development systems 100 can be selectively activated by way of signals from printer controller 82.

As is shown of FIGS. 2-5 printing module 48 has a primary imaging system 110, a charging subsystem 120, a writing subsystem 130, a first development station 140 and a second development station 200 that are each ultimately responsive to printer controller 82. Each printing module can also have its own respective local controller (not shown) or hardwired control circuits (not shown) to perform local control and feedback functions for an individual module or for a subset of the printing modules. Such local controllers or local hardwired control circuits are coupled to printer controller 82.

In this embodiment, dual image modulated toner development system 100 is shown incorporating writing subsystem 130, first development station 140 and second development station 200. In other embodiments other components of printer 20 or printing module 48 can optionally be used in dual image modulated toner development system 100, including but not limited to color separation processor 104 and half tone processor 106, primary imaging system 110 and charging subsystem 120.

Primary imaging system 110 includes a primary imaging member 112. In the embodiment of FIGS. 2-5, primary imaging member 112 is shown in the form of an imaging cylinder. However, in other embodiments primary imaging member 112 can take other forms, such as a belt or plate. As is indicated by arrow 109 in FIGS. 2-5, primary imaging member 112 is rotated by a motor (not shown) such that primary imaging member 112 rotates from charging subsystem 120, to writing subsystem 130, to first development station 140 and into a transfer nip 156 with a transfer subsystem 50.

In the embodiment of FIGS. 2-5, primary imaging member 112 has a photoreceptor 114. Photoreceptor 114 includes a photoconductive layer formed on an electrically conductive substrate. The photoconductive layer is an insulator in the substantial absence of light so that initial differences of potential VI can be retained on its surface. Upon exposure to light, the charge of the photoreceptor in the exposed area is dissipated in whole or in part as a function of the amount of the exposure. In various embodiments, photoreceptor 114 is part of, or disposed over, the surface of primary imaging member 112. Photoreceptor layers can include a homogeneous layer of a single material such as vitreous selenium or a composite layer containing a photoconductor and another material. Photoreceptor layers can also contain multiple layers.

Charging subsystem 120 is configured as is known in the art, to apply charge to photoreceptor 114. The charge applied by charging subsystem 120 creates a generally uniform initial difference of potential VEPL relative to ground. The initial difference of potential VEPL has a first polarity which can, for example, be a negative polarity. Here, charging subsystem 120 includes a grid 126 that is selected and driven by a power source (not shown) to charge photoreceptor 114. Other charging systems can also be used.

In this embodiment, an optional meter 128 is provided that measures the electrostatic charge on photoreceptor 114 after initial charging and that provides feedback to, in this example, printer controller 82, allowing printer controller 82 to send signals to adjust settings of the charging subsystem 120 to help charging subsystem 120 to operate in a manner that creates a desired initial difference of potential VI on photoreceptor 114. In other embodiments, a local controller or analog feedback circuit or the like can be used for this purpose.

Writing subsystem 130 is provided having a writer 132 that forms charge patterns on a primary imaging member 112. In this embodiment, this is done by exposing primary imaging member 112 to electromagnetic or other radiation that is modulated according to color separation image data to form a latent electrostatic image (e.g., of a color separation corresponding to the color of toner deposited at printing module 48) and that causes primary imaging member 112 to have image modulated charge patterns thereon.

In the embodiment shown in FIGS. 2-5, writing subsystem 130 exposes the uniformly-charged photoreceptor 114 of primary imaging member 112 to actinic radiation provided by selectively activating particular light sources in an LED array or a laser device outputting light directed at photoreceptor 114. In embodiments using laser devices, a rotating polygon (not shown) is used to scan one or more laser beam(s) across the photoreceptor in the fast-scan direction. One dot site is exposed at a time, and the intensity or duty cycle of the laser beam is varied at each dot site. In embodiments using an LED array, the array can include a plurality of LEDs arranged next to each other in a line, all dot sites in one row of dot sites on the photoreceptor can be selectively exposed simultaneously, and the intensity or duty cycle of each LED can be varied within a line exposure time to expose each dot site in the row during that line exposure time. While various embodiments described herein describe the formation of an imagewise modulated charge pattern on a primary imaging member 112 by using a photoreceptor 114 and optical type writing subsystem 130, such embodiments are exemplary and any other system method or apparatuses known in the art for forming an imagewise modulated pattern differences of potential on a primary imaging member 112 consistent with what is described or claimed herein can be used for this purpose.

As used herein, an "engine pixel" is the smallest addressable unit of primary imaging system 110 or in this embodiment on photoreceptor 114 which writer 132 (e.g., a light source, laser or LED) can expose with a selected exposure different from the exposure of another engine pixel. Engine pixels can overlap, e.g., to increase addressability in the slow-scan direction (S). Each engine pixel has a corresponding engine pixel location on an image and the exposure applied to the engine pixel location is described by an engine pixel level. The engine pixel level is determined based upon the density of the color separation image being printed by printing module 48.

It will be appreciated that for any given combination of primary imaging member 112 and writing subsystem 130 there is a range of differences of potential that can be repeatably established on a photoreceptor 114 or other type of primary imaging member 112 by writing subsystem 130. Typically, such a range is between a higher voltage level above which the response of the photoreceptor or other type of primary imaging member 112 becomes less repeatable or predictable than preferred and a lower difference of potential below which the response of the photoreceptor or primary imaging member 112 becomes less repeatable or predictable than preferred. Accordingly, engine pixel levels used to form an image are generally calculated to create a difference of potential at each engine pixel location that is within a range determined based upon the higher difference of potential and the lower difference of potential and during printing or pre-printing processes a range of potential density with variations in image data to be printed is converted into engine pixel image modulated differences of potential that are within the determined range of differences of potential and formed on primary imaging member 112 or photoreceptor 114 by writing subsystem 130.

Writing subsystem 130 is a write-black or discharged-area development (DAD) system where image wise modulation of the primary imaging member 112 is performed according to a model under which a toner is charged to have the same first polarity as the charge on primary imaging member 112. As is used herein difference of potential refers to a difference of potential between the cited member and ground unless otherwise specified as the difference of potential between two members. This toner is urged to primary imaging member 112 by a net difference of potential between a first development station 140 and engine pixel locations on a the primary imaging member 112 during development. In the embodiment of FIGS. 2-5 this difference of potential varies based on the difference of potential at each engine pixel location. Toner of the same potential is urged to deposit onto engine pixel locations on the primary imaging member 112 where the difference of potential of an engine pixel location VEPL of primary imaging member 112 has been modulated from the initial difference of potential VI to a lower engine pixel level VEPL. The magnitude of the difference of potential an engine pixel location VEPL inversely corresponds to the engine pixel level for the engine pixel location.

Accordingly, in a DAD system, toner develops on the primary imaging member 112 at engine pixel locations that have a difference of potential VEPL that is lower than a development difference of potential and does not develop on the primary imaging member 112 at locations that have an image modulated difference of potential VEPL that is greater than a development difference of potential used to develop a toner at such locations. It will be appreciated that in this regard, any or all of printer controller 82, color separation image processor 104 and half tone processor 106 can optionally process image data and printing instructions in ways that cause image modulated differences of potential to be generated according to this DAD model.

Engine pixel locations having image modulated differences of potential that are less than the initial difference of potential VI therefore correspond to areas of primary imaging member 112 onto which toner will be deposited during development while areas having an image modulated potential that is above the development difference of potential are not developed with toner.

After writing, primary imaging member 112 has an image modulated difference of potential at each engine pixel location VEPL that can vary between a higher potential VH that can be at the initial difference of potential VI reflecting in this embodiment, a potential at an engine pixel location that has not been exposed, and that can be at a lower level VL reflecting in this embodiment a lower potential at an engine pixel location that has been exposed by an exposure at an upper range of available exposure settings.

Another meter 134 is optionally provided in this embodiment and measures charge within a non-image test patch area of photoreceptor 114 after the photoreceptor 114 has been exposed to writer 132 to provide feedback related image modulated differences of potential created using writing subsystem 130 and photoreceptor 114. Other meters and components (not shown) can be included to monitor and provide feedback regarding the operation of other systems described herein so that appropriate control can be provided.

First development station 140 has a first toning shell 142 that provides a first developer having a first toner 158 near primary imaging member 112. First toner 158 is charged and has the same polarity as the initial charge VI on primary imaging member 112 and as any image modulated potential VEPL of the engine pixel locations on primary imaging member 112. First development station 140 also has a first supply system 146 for providing charged first toner 158 to first toning shell 142 and a first power supply 150 for providing a bias for first toning shell 142. First supply system 146 can be of any design that maintains or that provides appropriate levels of charged first toner 158 at first toning shell 142 during development. Similarly, first power supply 150 can be of any design that can maintain the bias described herein. In the embodiment illustrated here, first power supply 150 is shown optionally connected to printer controller 82 which can be used to control the operation of first power supply 150.

The bias at first toning shell 142 creates a first development difference of potential VD1 relative to ground. The first development difference of potential VD1 forms a first net development difference of potential VNET1 between first toning shell 142 and individual engine pixel locations on primary imaging member 112. The first net development difference of potential VNET1 is the first development difference of potential VD1 less any image modulated difference of potential VEPL at the engine pixel location.

First toner 158 on first toning shell 142 develops on individual engine pixel locations of primary imaging member 112 in an amount according to the first net development potential VNET1 for the individual engine pixel. The amount of first toner developed at such an engine pixel location can increase along with increases in the first net development difference of potential VNET1 for each individual engine pixel location and these increases in amount can occur monotonically with increases in the first net development difference of potential. Such development produces a first toner image 25 on primary imaging member 112 having first toner 158 in amounts at the engine pixel locations that inversely correspond to the engine pixel levels associated with the engine pixel locations.

The electrostatic forces that cause first toner 158 to deposit onto primary imaging member 112 can include Coulombic forces between charged toner particles and the charged electrostatic latent image, and Lorentz forces on the charged toner particles due to the electric field produced by the bias voltages.

In one example embodiment, first development station 140 employs a two-component developer that includes toner particles and magnetic carrier particles. In this embodiment, first development station 140 includes a magnetic core 144 to cause the magnetic carrier particles near first toning shell 142 to form a "magnetic brush," as known in the electrophotographic art. Magnetic core 144 can be stationary or rotating, and can rotate with a speed and direction the same as or different than the speed and direction of first toning shell 142. Magnetic core 144 can be cylindrical or non-cylindrical, and can include a single magnet or a plurality of magnets or magnetic poles disposed around the circumference of magnetic core 144. Alternatively, magnetic core 144 can include an array of solenoids driven to provide a magnetic field of alternating direction. Magnetic core 144 preferably provides a magnetic field of varying magnitude and direction around the outer circumference of first toning shell 142. Further details of magnetic core 144 can be found in U.S. Pat. No. 7,120,379 to Eck et al., issued Oct. 10, 2006, and in U.S. Publication No. 2002/0168200 to Stelter et al., published Nov. 14, 2002, the disclosures of which are incorporated herein by reference. In other embodiments, first development station 140 can also employ a mono-component developer comprising toner, either magnetic or non-magnetic, without separate magnetic carrier particles. In further embodiments, first development station 140 can take other known forms that can perform development in any manner that is consistent with what is described and claimed herein.

In the embodiment of FIGS. 2-5, a second development station 202 has a second toning shell 204 that provides a second developer having a second toner 208 near primary imaging member 112. Second toner 208 is charged and has a potential of the same polarity as first toner 158, the initial charge VI on primary imaging member 112 and any image modulated potential of the engine pixel locations VEPL. Second development station 202 also has a second toner supply system 206 for providing charged second toner 208 of the first polarity to second toning shell 204 and a second power supply 210. Second toner supply system 206 can be of any design that maintains or that provides appropriate levels of charged second toner 208 at a second toning shell 204 during development.

Similarly, second power supply 210 can be of any design that can maintain the bias described herein on second toning shell 204. In the embodiment illustrated here, second power supply 210 is shown optionally connected to printer controller 82 which can be used to control operation of second power supply 210.

As is also shown in FIG. 3, when a bias is applied at a second toning shell 204 by second power supply 210, a second development difference of potential VD2 is created relative to ground. The second development difference of potential VD2 forms a second net development difference of potential VNET2 between second toning shell 204, any first toner 158 at an individual engine pixel location on primary imaging member 112 and the image modulated difference of potential VEPL at the individual engine pixel location. The second net development difference of potential VNET2 for an engine pixel location is the second development difference of potential VD2 less any image modulated difference of potential VEPL at the engine pixel location and less any first toner difference of potential VFT provided by any first toner 158 at the engine pixel location.

Second toner 208 on second toning shell 204 can deposit on individual engine pixel locations on primary imaging member 112 in a first amount that reflects the difference between first development difference of potential VD1 and second development difference of potential VD2 and in a second amount that monotonically increases as a function of the net second development difference of potential VNET2. Such increases can occur monotonically with increases in the net second development difference of potential VNET2.

The electrostatic forces that cause second toner 208 to deposit onto primary imaging member 112 can include Coulombic forces between charged toner particles and the charged electrostatic latent image, and Lorentz forces on the charged toner particles due to the electric field produced by the bias voltages. Second development station 202 can optionally employ a two-component developer or a one component developer and a magnetic core as described generally above with reference to first development station 140.

Figure 4:
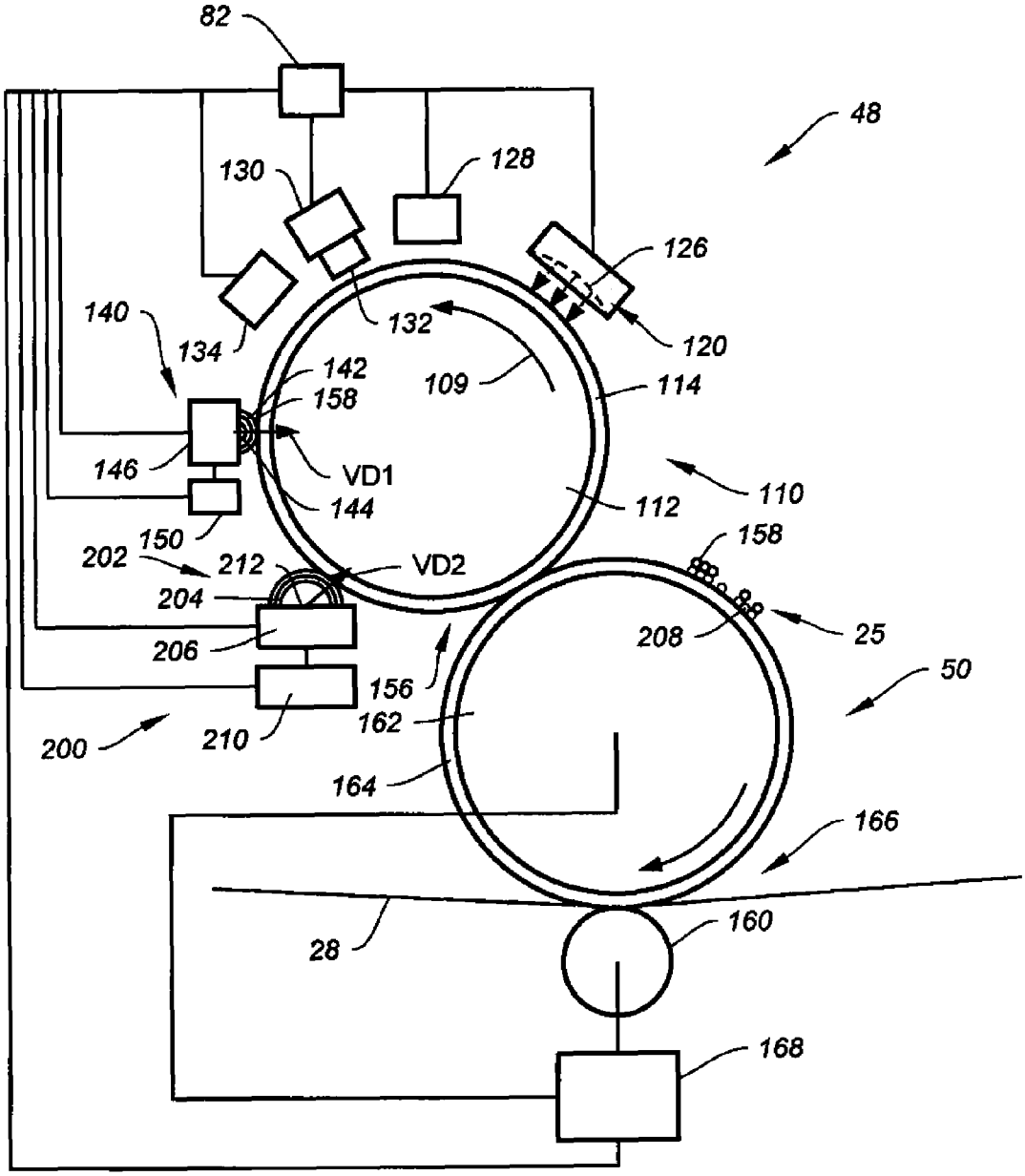
FIG. 4 illustrates the embodiment of FIG. 2 during transfer.
Figure 5:
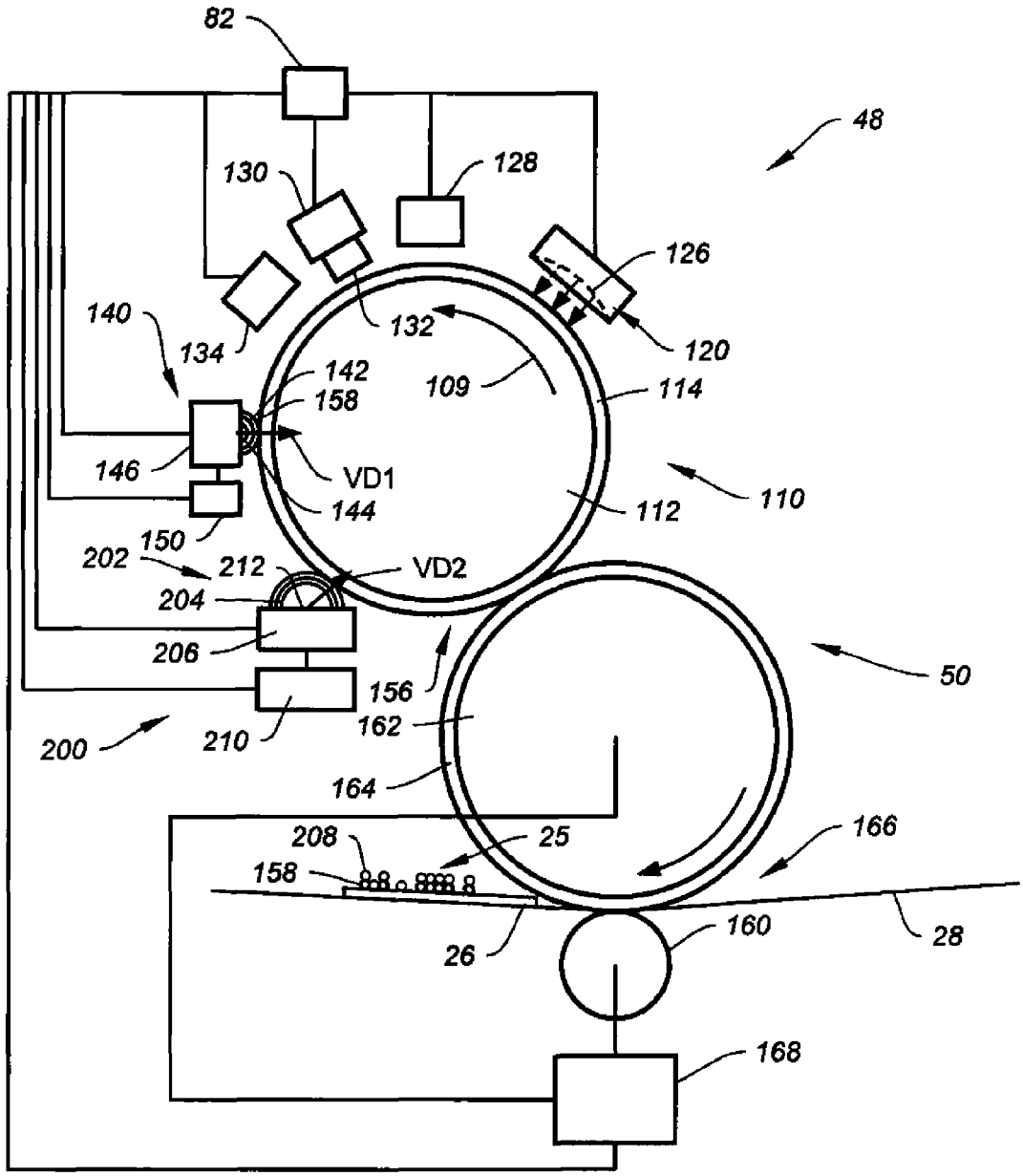
FIG. 5 illustrates the embodiment of FIG. 2 during transfer.

As is shown in FIG. 4, in this embodiment, after a first toner image 25 is formed having first toner 158 and second toner 208, rotation of primary imaging member 112 causes first toner image 25 to move into a first transfer nip 156 between primary imaging member 112 and a transfer subsystem 50. As shown in FIG. 4, in this embodiment transfer subsystem 50 has an intermediate transfer member 162 that receives toner image 25 at first transfer nip 156. As is shown in FIG. 5, intermediate transfer member 162 then rotates to move first toner image 25 to a second transfer nip 166 where a receiver 26 receives first toner image 25. In this embodiment, transfer subsystem 50 includes transfer backup member 160 opposite transfer member 162 at second transfer nip 166. Receiver transport system 28 passes at least in part through transfer nip 166 to position receiver 26 to receive toner image 25. In this embodiment, intermediate transfer member 162 is shown having an optional compliant transfer surface 164.

After a toner image 25 has been formed on primary imaging member 112 or has been transferred been transferred to intermediate transfer member 162, adhesion forces such as van der Wags forces resist separation of toner image 25 from these members unless another force is provided that overcomes these adhesive forces. In the embodiment of FIG. 3, the first toner difference of potential VFT is used to allow such force to be applied to toner image 25 to enable transfer of toner image 25 onto intermediate transfer member 162 and later to enable transfer from intermediate transfer member 162 and on to a receiver 26. As is illustrated in the embodiment of FIGS. 2-5 a transfer power supply 168 creates a difference of potential between primary imaging member 112, and a difference of potential between transfer member 162 and transfer backup member 160. These differences in potential are used to cause toner image 25 to transfer from primary imaging member 112 to intermediate transfer member 162 and to transfer from the intermediate transfer member 162 to the receiver 26.

Returning to FIG. 1, it will understood that printer controller 82 causes one or more of individual printing modules 40, 42, 44, 46 and 48 to generate a toner image 25 for transfer by respective transfer subsystems 50 to a receiver 26 in registration to form a composite toner image 27.

Second toner 208 is different than first toner 158. This can take many forms, in one embodiment, first toner 158 can have first color characteristics while second toner 208 has different second color characteristics. In one example of this type, first toner 158 can be a toner of a first color having a first hue and the second toner 208 can be a toner having the first color and a second different hue.

First toner 158 and second toner 208 also can have different material properties. For example, in one embodiment first toner 158 can have a first viscosity and the second toner 208 can have a second viscosity that is different from the first viscosity. In another embodiment, first toner 158 can have a different glass transition temperature than second toner 208. In one example of this type, second toner 208 can have a lower glass transition temperature than the first toner 158. In certain embodiments, second toner 208 can take the form of a toner that is clear, transparent or semi-transparent when fused. In other embodiments, second toner 208 can have finite transmission densities when fused.

First toner 158 and second toner 208 can be differently sized. For example, and without limitation, first toner 158 can comprise toner particles of a size between 4 microns and 9 microns while second toner 208 can have toner particles of a size between 10 microns and 20 microns or more. In another non-limiting example, second toner 208 can comprise toner particles of a size between 4 microns and 9 microns while first toner 158 can have toner particles of a size between 10 microns and 20 microns or more. First toner 158 and second toner 208 can also have other different properties such as different shapes, can be formed using different processes, or can be provided with additional additives, coatings or other materials known in the art that influence the development, transfer or fusing of toner.

In general then, a printer 20 having a printing module 48 with dual image modulated toner development system 100 can develop either of a first toner 158 and second toner 208 at an engine pixel location on a primary imaging member 112 according to and in precise registration with image modulated differences of potential at specific engine pixel locations on a primary imaging member 112. Thus, printer 20 can selectively apply either of first toner 158 and second toner 208 by appropriate selection of an image modulated difference of potential at an engine pixel location.

Figure 6A:
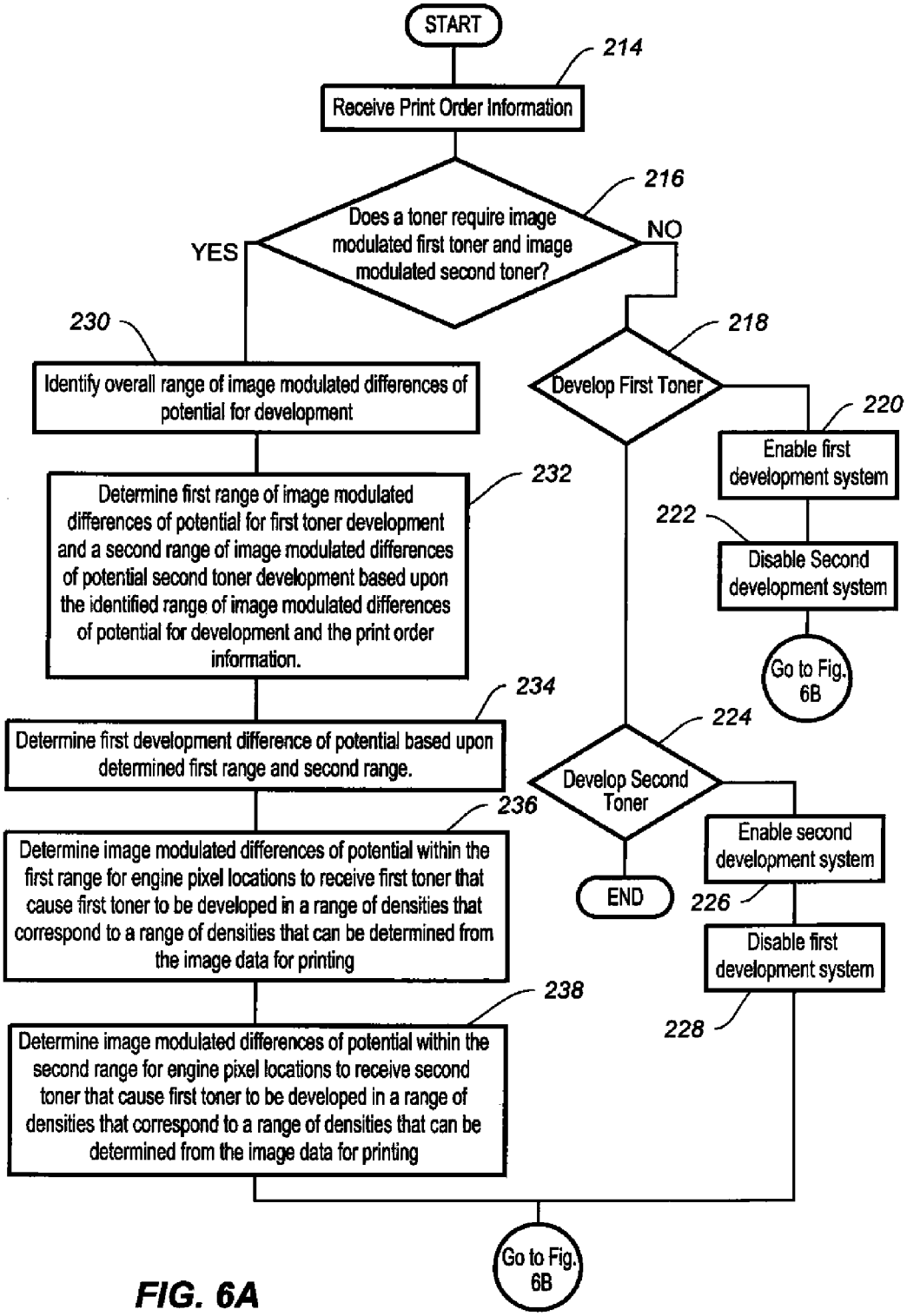
FIGS. 6A-6B show a first embodiment of a printing method using a printing module having a toner co-development system.
Figure 6B:
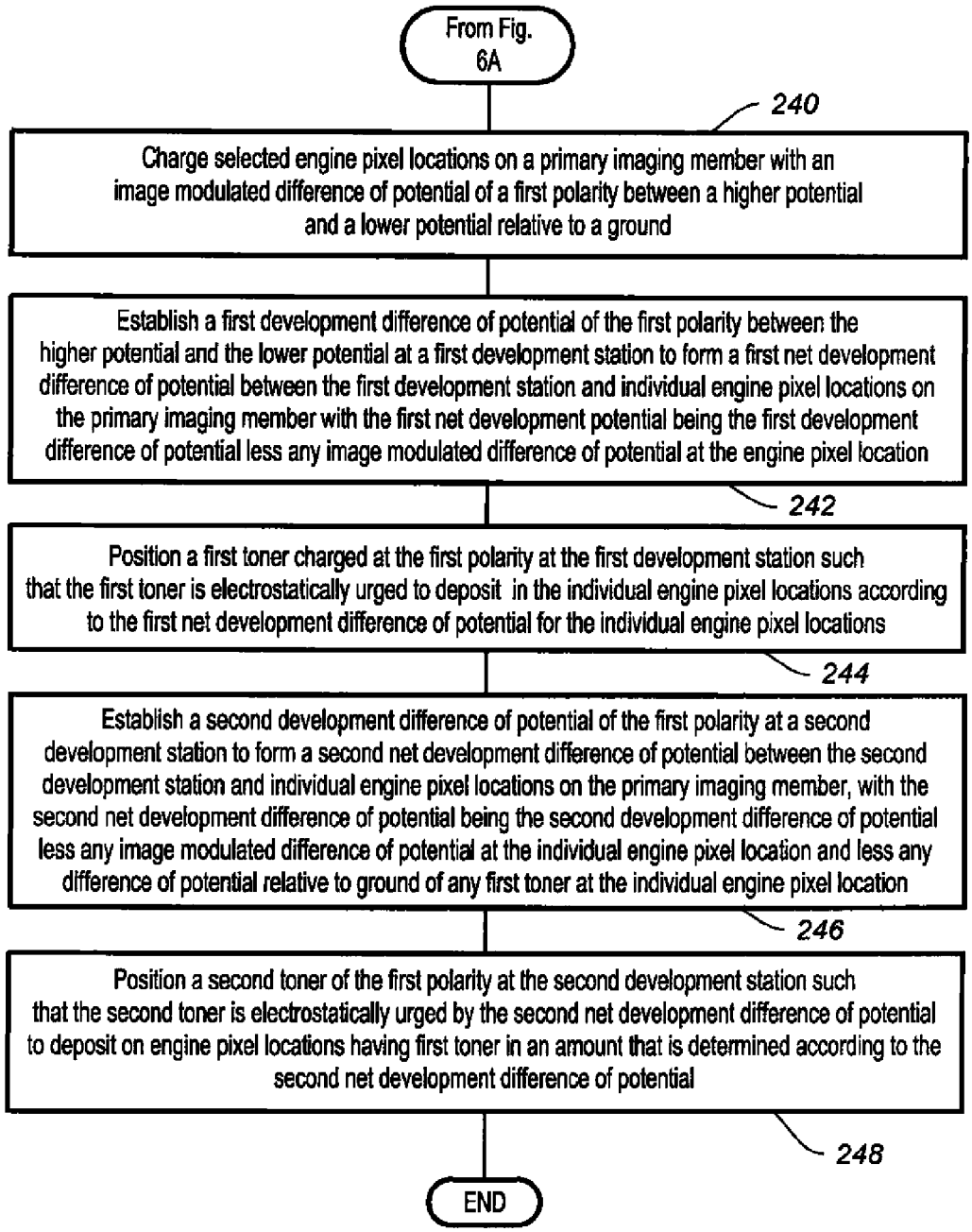

FIGS. 6A and 6B show a first embodiment of a method for operating a printer to provide at least one toner image 25 that can include both image modulated first toner 158 and image modulated second toner 208. In accordance with the illustrated method, print order information for printing is received. In the embodiment of FIG. 1, this print order information can be received from a source of print order information 108. The print order information can include for example image data and printing instructions or information that can be used to obtain or determine such image data or printing instructions as is generally described above.

A determination is then made as to whether making a print according to the print order information involves generating a toner image 25 that has an image modulated first toner 158 and an image modulated second toner 208 (step 216).

In one embodiment, this determination is made based upon the print order information. For example, a color image data can be determinative of whether such a toner image 25 is to be generated. Alternatively, this determination can be made based upon printing instructions that can be included with the print order information. In still another alternative, this determination can be made based upon information that can be derived from print order information or the image data.

In still other embodiments, this determination can be made by analyzing the color, textural, functional, electrical, mechanical, chemical or biological properties that the print order information indicates are to be provided in an image identifying a particular combination of image modulated first toner 158 and second toner 208 to be used to render an image having such properties. For example, where analysis of the print order indicates that a first set of locations in an image is to have a clear toner applied thereto in a pattern that enhances gloss, while a second set of locations in the same image is to have a pattern of raised clear areas providing a tactile feel or structural element, printer controller 82 can determine that a printing module 48 having a dual image modulated toner development system 100 with a first toner 158 having large clear toner particles and a second toner 208 having smaller clear toner particles is to be used to provide such different toners in the same clear toner image 25.

In further embodiments, settings made using user input system 84 can be used to determine a need to generate a toner image 25 having a first toner 158 and second toner 208.

It will be appreciated that these examples are not limiting and that any circumstance known in the art suggesting that a print is to be generated using a toner image 25 having both first toner 158 and second toner 208 can drive these determinations. It will be further appreciated that in printer 20 of FIG. 1 such determinations can be made automatically by, for example, printer controller 82 or color separation processor 104 acting alone or in combination.

As is shown in FIG. 6A, where it is determined that a toner image 25 does not require both image modulated first toner 158 and image modulated second toner 208, it is then decided whether first toner 158 is to be developed for toner image 25 (step 218). Where first toner is to be developed, first development system 140 is enabled (step 220) and second development station 202 is disabled (step 222), and the process moves to the steps described in FIG. 6B while omitting steps 246 and 248. Further, where it is determined that toner image 25 does not include first toner 158, a determination is made as to whether second toner 208 is to be used (step 224) where it is determined that second toner 208 is to be developed, second development station 202 is enabled (step 226) and first development station 140 is disabled (step 228) and the process moves to the steps described in FIG. 6B while omitting steps 242 and 244. It will be appreciated that when only one of first toner 158 and second toner 208 are to be developed, step 240 can optionally adjust either of the first development difference of potential VD1 or the second development difference of potential VD2 and the range image modulated differences of potential to provide a greater range of image modulated differences of potential VEPL when forming images using only one of either first toner or second toner 208. Where no first toner 158 or second toner 208 is to be developed the process concludes and no toner is developed.

However, where it is determined that a toner image 25 having an image modulated first toner 158 and an image modulated second toner 208 is to be printed (step 216) an overall range of image modulated differences of potential available for use in generating toner image 25 having image modulated first toner 158 and image modulated second toner 208 is identified (step 230).

As has been discussed generally above and as will now be discussed with reference to FIG. 7A, for a printing module such as printing module 48 image modulated development of a single toner (illustrated here as first toner 158) is typically provided in a repeatable or useful manner within a range of available development differences of potential 190 between a higher difference of potential VH and a lower difference of potential VL. Many printers provide a range 192 of image modulated differences of potential VEPL for developing a single toner that is close to or equal to the available range 190 in order to achieve a broad range of possible image modulated densities to provide greater latitude for development of the single toner.

Figure 7A:
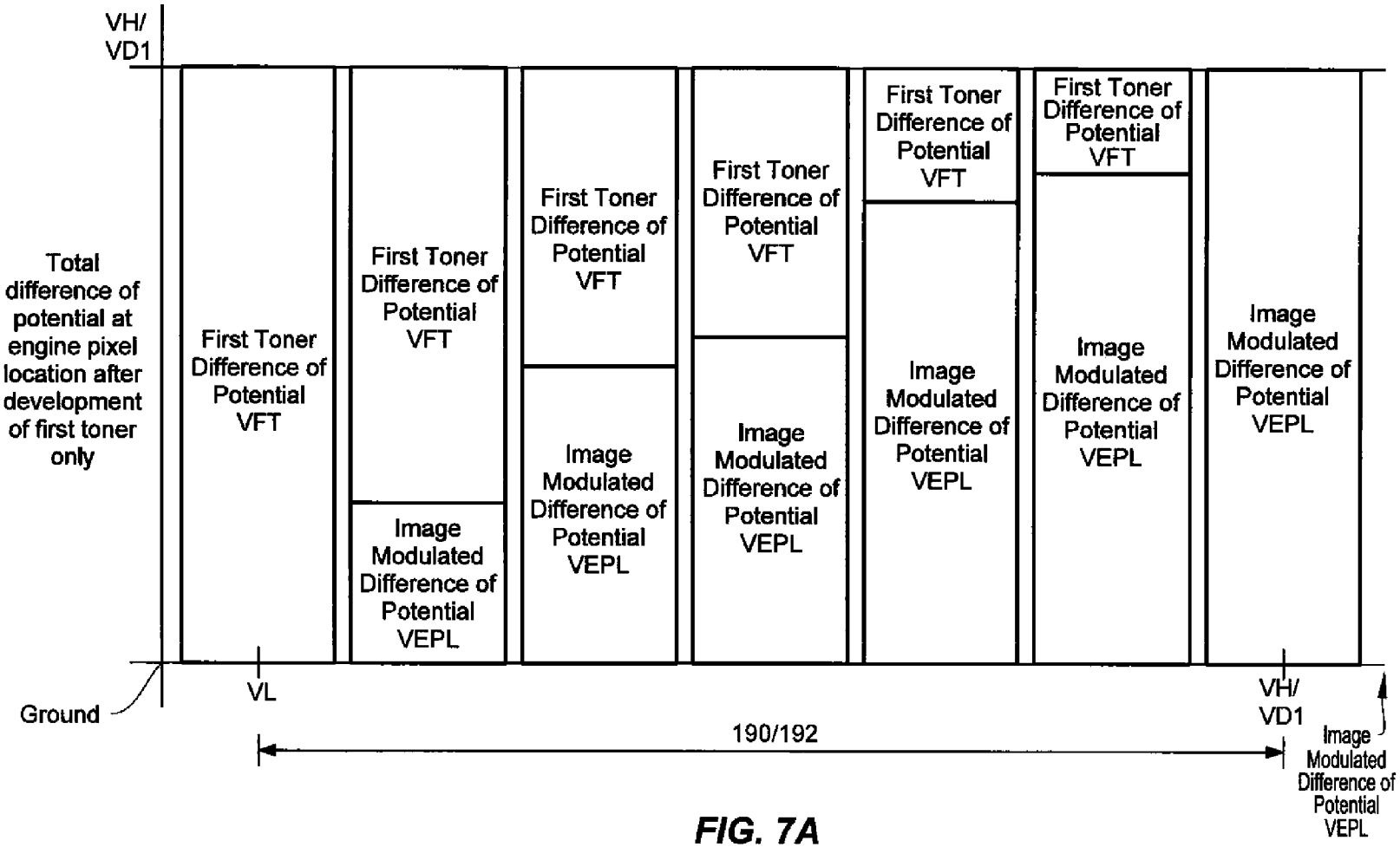
FIGS. 7A-7D illustrate ways in which ranges of image modulated differences of potential can be provided to enable image modulated first toner development and image modulated second toner development in response to an image modulated development difference of potential at an engine pixel location.
Figure 7B:
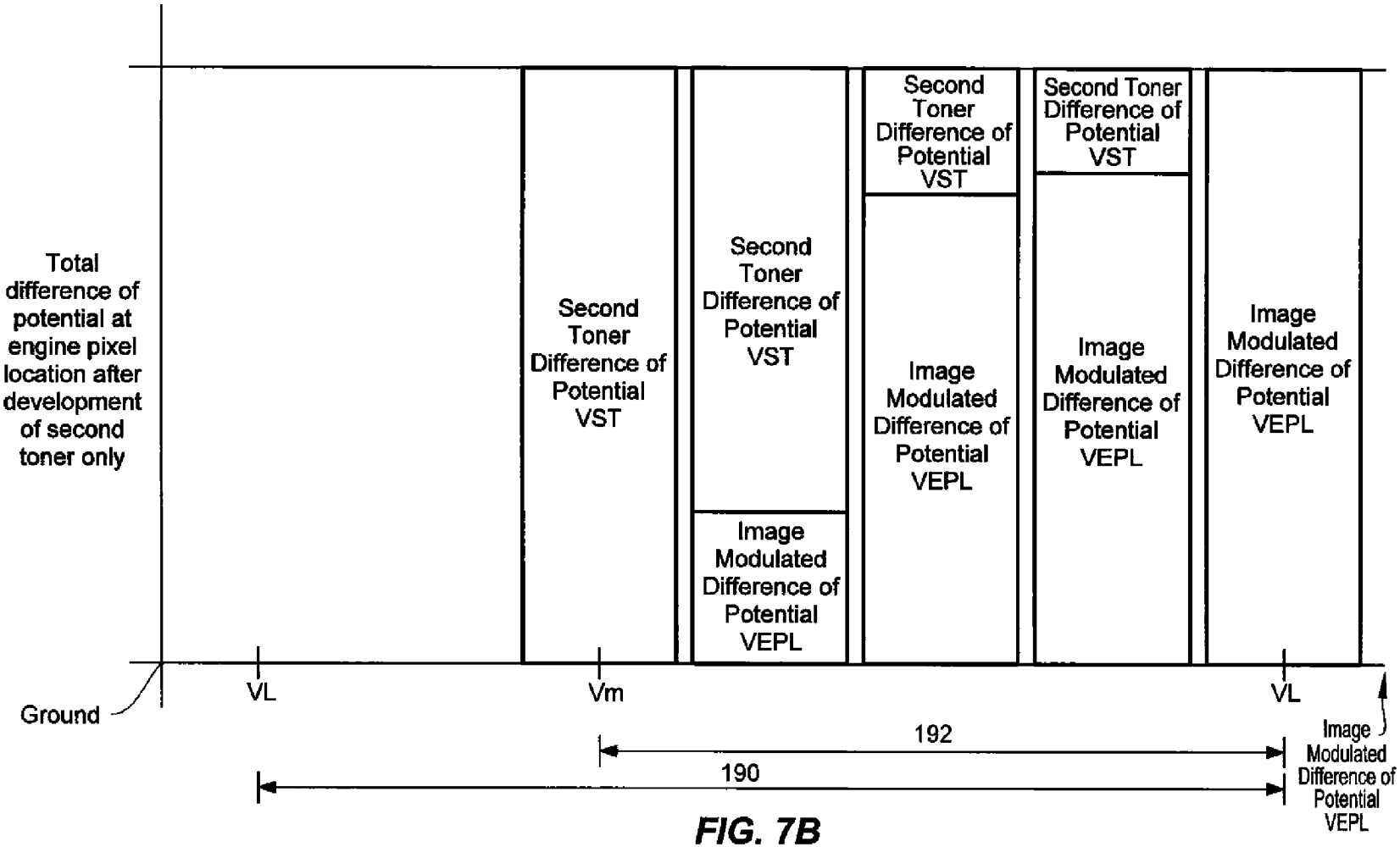

In FIG. 7A a single toner range of image modulated differences of potential 192 is shown that is generally equivalent with the available range 190. Alternatively, as is shown in FIG. 7B in some situations, the single toner range of image modulated differences of potential 192 (shown here as second toner 208) occupies only a portion of the available range 190 of differences of potential between higher difference of potential V11 and lower difference of potential VL.

When a first toner 158 and a second toner 208 are to be developed in an image modulated fashion to form a toner image 25 generated by a single print module such development is made in response to a common image modulated difference of potential VEPL for an individual engine pixel location on a primary imaging member 112. Accordingly, a range of image modulated differences of potential for use in development of toner image 25 is identified that will cause an image modulated first toner 158 and an image modulated second toner 208 to develop to define provide a portion of the identified range of image modulated differences of potential 190 or the single toner range of image modulated differences of potential (if different) for use in causing image modulated development of first toner 158 and to provide a portion of portion of the available range of image modulated differences of potential 190 for use in causing that will cause image modulated development of the second toner 208. The identified range can be either the available range 190 or a single toner range 192. However, in certain embodiments either of the first toner 158 or the second toner 208 can have a response to image modulated differences of potential that require adjustment of either of the identified ranges such as where for example one of the first toner 158 or the second toner 208 has a charge to mass ratio that is significantly different from that of the single color toners typically used in the printing module.

Thus a next step in the method of FIGS. 6A and 6B is the step of determining a range of image modulated differences of potential that will cause image modulated development of first toner 158 and a second range of image modulated differences of potential that will cause image modulated development of second toner 208 based upon the identified range of image modulated differences of potential for development and the print order information (step 232).

Figure 7C:
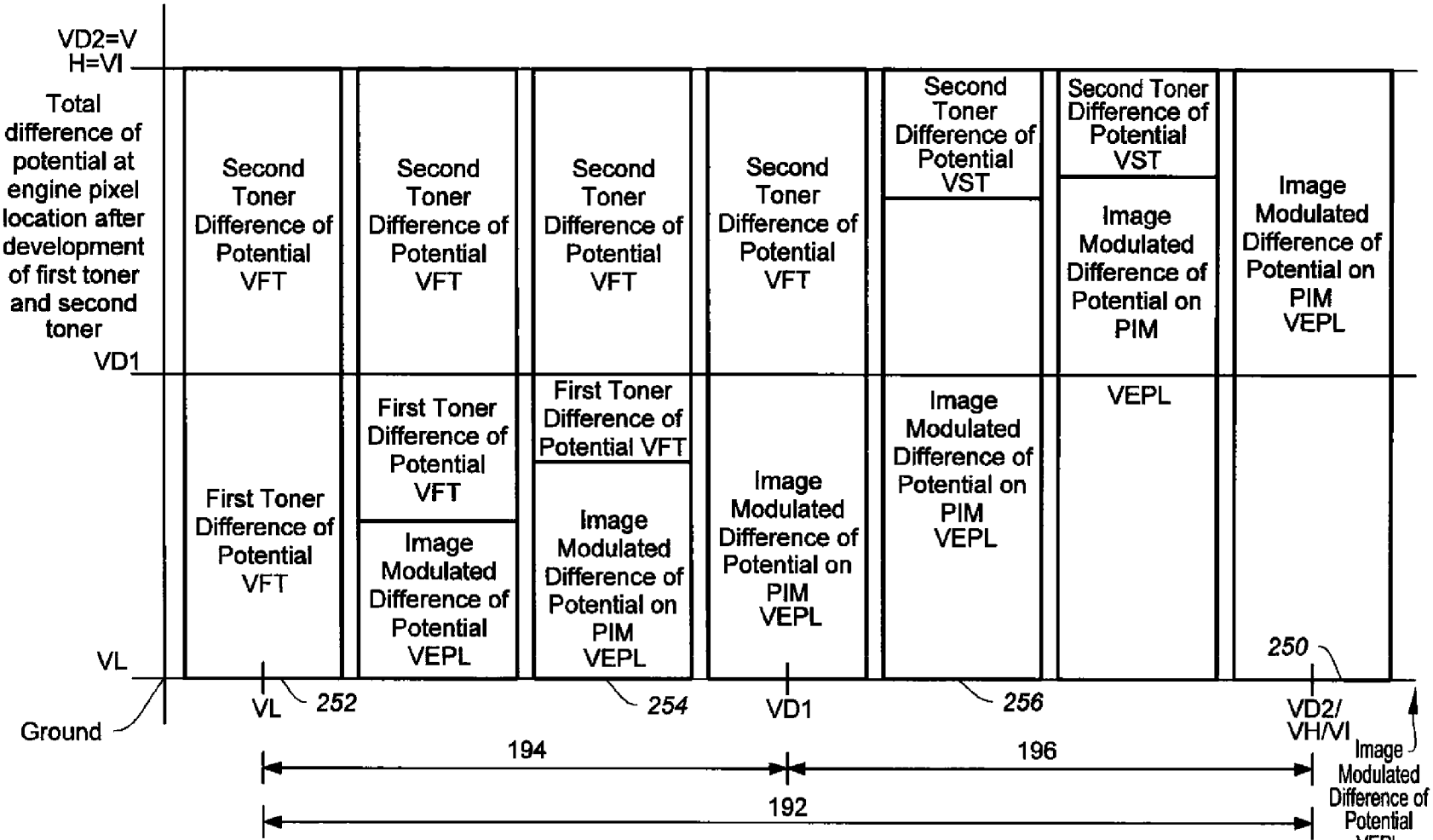

In FIG. 7C, the single toner range 192 of FIG. 7A is identified as the basis for determining the first toner development range 194 and the second toner development range 196. Accordingly, the single toner range 192 is divided into a first toner range 194 of image modulated differences of potential VEPL that is based upon the lower difference of potential VL at a first end of the first toner development range 194 and the first development difference of potential VD1 at another end of the first toner development range 194. Portions of the single toner range 192 that are not incorporated in first toner development range 194 can be used to provide a second toner development range 196. In FIG. 7C, second toner development range 196 begins at a level of image modulated difference of potential VEPL at about the first development difference of potential VD1 and extends generally to an image modulated difference of potential that is at about the second development difference of potential VD2 which can extend as shown in FIG. 7C to a higher difference of potential VL that is at the initial difference of potential VI.

The first toner development range 194 and second toner development range 196 can be determined based upon analysis of image densities from image data and, optionally, other information from the print order information. In one example of this type analysis of such print order information can define the way in which first toner 158 and second toner 208 are to be used in forming the toner image 25 in a way that can provide guidance as to the appropriate distribution of the range of image modulated difference of potential in the single toner development range, such as by providing information from which the range of density variations required of first toner 158 and second toner 208 to form toner image 25 can be determined and the required density variations can be used to guide apportionment of single toner development range 192 between first toner development range 194 and second toner development range 196.

In another example of this type, in one embodiment first toner 158 can be a toner of a specific type such as a color that is not within a normal set of subtractive colors used to in combination to form a range of colors but that has a specific and exact color such as a color used in a trademark. In such cases, the first toner development range 194 can include only the ranges of image modulated differences of potential that are necessary cause such a first toner 158 to develop to the desired color. Where this occurs, the second toner development range 196 can be significantly larger than the first toner development range 194.

In contrast it can be useful to provide a first toner development range 194 that is broader than a second toner development range 196 where for example, the second toner 208 is a clear toner that is provided to protect an image modulated pattern of an underlying first toner 158. In such cases, greater breadth can be give to the first toner development range 194. More balanced outcomes are also possible.

The first toner development range 194 and second toner development range 196 can be defined at least in part based on any differences between first toner 158 and second toner 208 and the printing outcomes desired when such toners are used. For example, the first toner development range 194 and the second toner development range 196 can be determined based upon differences in color characteristics between the first toner 158 and the second toner 208, such as where the first toner 158 is a heavily pigmented dark black toner where even small increases in the extent of development of first toner 158 create significant differences in image density and where second toner 208 provides toner that has black pigmentation at a significantly lower density for use in providing more refined differences in image density. In such a case, first toner 158 can be assigned a first toner development range 194 that is significantly smaller than a second toner development range 196.

In another example, first toner 158 can include small diameter particle size toner while second toner 208 can include a larger diameter toner particle size. In such a case, the first toner development range 194 and second toner development range 196 can be adjusted as required to provide preferential differential range for development as required to achieve specific printing outcomes using such a first toner 158 and second toner 208.

It will be appreciated that many other examples of this type are possible and that the systems and methods described herein can be used to provide image modulated amounts of first toner 158 and second toner 208 in a single toner image to support, generally, any known printing outcome that requires that a single printing module gnat toner images having specific combinations of different toners and that the exact determination of the first toner development range 194 and second toner development range 196 can be determined to achieve such outcomes. Further, the first toner development range 194 and second toner development range 196 can be established based upon toner characteristics, print module specific characteristics or receiver characteristics.

In the embodiment shown in FIG. 7C, an image modulated difference of potential VEPL in the first toner development range 194 causes first toner 158 to develop according to the image modulated difference of potential while an image modulated difference of potential VEPL in the second toner range 196 causes second toner 208 to develop in according to the image modulated difference of potential.

Thus, in this embodiment, when first toner 158 and second toner 208 are both made available for development and only one of these is selectively made to develop in an image modulated fashion at an individual engine pixel location by the image modulated difference of potential VEPL at the engine pixel location.

In the example of FIG. 7C both the first toner development range 194 and the second toner development range 196 are less than the single toner range of differences of potential 192 or the available range of differences of potential 190 were available for development of first toner 158 and second toner 208 and this can require that determination of image modulated difference of potential used to drive image modulation of first toner 158 and second toner 208 is performed in a manner that is different than that used for single color development.

Figure 7D:
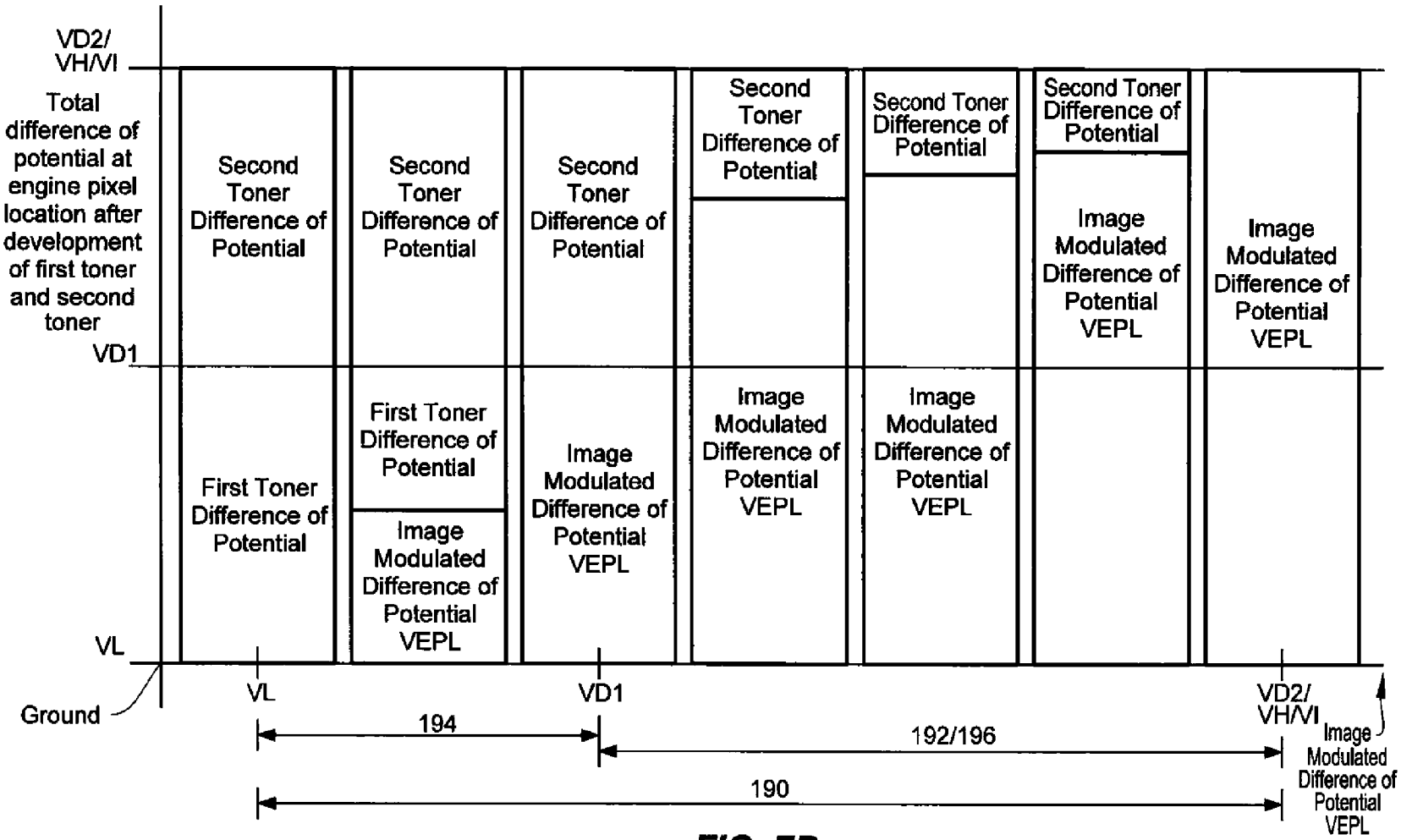

FIG. 7D shows another example of a first toner development range 194 and a second toner development range 196 that can be made where the single toner development range 192 is less than the available range 190 as is shown above in FIG. 7B. Here, there is sufficient available range 190 to a first toner development range 194 to be created alongside a second toner development range 196 that is the same as the single toner development range 192. Accordingly, in this example it can be possible to determine image modulated differences of potential for the second toner 208 that are within a same range as that used for single toner development, while still allowing a desired first toner development range 194. However, here too the determination of image modulated differences of potential will be made in a manner that reflects the a portion of the available range is used to cause first toner development and that reflects any shift in the absolute levels of the differences of potential that define the second toner development range 194. It will be appreciated from FIGS. 7A-7D that selection of the ranges for the first range 194 and the second range 196 can be determinative of the printing outcome that is achieved.

Returning to FIG. 6A it will be observed that once that the first toner development range 194 and the second toner development range 196 are determined first development difference of potential VD1 can be determined (step 234). This is because, as is shown in FIGS. 7C and 7D the first development difference of potential VD1 provides a separation between the first toner development range 194 and the second toner development range 196. The first development difference of potential VD1 is therefore set in accordance with determined first toner development range and the second toner development range. In this embodiment the second development potential VD2 is greater than the first development difference of potential VD1. This result can be achieved by defining the second development difference of potential VD2 at a level that is at the higher difference of potential VH. Alternatively, in certain embodiments, the second development difference of potential VD2 will be by positioning VD2 at a level that relative to the first development difference of potential VD1 that creates the second toner development range 196.

Image modulated differences of potential are determined within the first toner development range 194 to cause first toner 158 to be developed in a range of densities that correspond to a range of densities that can be determined from the print order information (step 236). In general this is done by mapping the range of densities of first toner 158 indicated by the print order information into the first toner development range 194. Such mapping can be linear or otherwise depending on the extent and nature of differences between the range of densities that are indicated in the print order information and the range of densities that are possible given first toner development range 194. This can be influenced by the extent to which writing subsystem 130 is capable of providing image modulated differences of potential at an engine pixel location that can be differentially developed by the first development station 140.

Similarly, where the second range 196 is less than the range of image modulated differences of potential used for a single toner 192, image modulated differences of potential are determined within the second toner development range 196 to cause second toner 208 to be developed in a range of densities that correspond to a range of densities that can be determined from the print order information (step 238). In general this is done by mapping the range of densities of first toner 208 indicated by the print order information into the second toner development range 196. Such mapping can be linear or otherwise depending on the extent and nature of differences between the range of densities that are indicated in the print order information and the range of densities that are possible given second toner development range 196. This can be influenced by the extent to which writing subsystem 130 is capable of providing image modulated differences of potential at an engine pixel location that can be differentially developed by the second development station 200.

Such mapping can also be influenced by optical or functional characteristics of the toner, the printing process used develop or transfer toner as well as characteristics of the receiver onto which the first toner 158 and the second toner 208 will be transferred.

Turning now to FIG. 6B Engine pixel locations are charged with the determined image modulated differences of potential VEPL (step 240). This can be done, for example, as described above in the printing module 48 of FIGS. 2-5 using charging subsystem 120 and writing subsystem 130 to expose a photoreceptor 114 to selectively release charge on photoreceptor 114. In other embodiments, this step can also be performed using any other charging-writing system that is compatible with a discharge area development process.

The determined first development difference of potential VD1 of the first polarity is established at first toning shell 142 using, in this example, first power supply 150. This creates a first net development difference of potential VNET1 defined by the difference between the first development difference of potential VD1 at first toning shell 142 and the individual image modulated difference of potential VEPL at the individual engine pixel locations on primary imaging member 112. The first net development difference of potential VNET1 for an engine pixel location is the first development difference of potential VD1 less any image modulated difference of potential VEPL at the engine pixel location (step 242).

Particles of first toner 158 are charged to the first polarity and positioned between first toning shell 142 and the engine pixel locations so that the first net development difference potential VNET1 electrostatically urges first toner 158 to deposit first toner 158 at individual engine pixel locations according to the first net development potential VNET1 for the individual picture element locations (step 244).

The determined second development difference of potential VD2 of the first polarity is established at second toning shell 204 using for example, second power supply 210. This creates a second net development difference of potential VNET2 between the second toning shell 204 and the individual engine pixel locations on the primary imaging member. The second net development difference of potential VNET2 between the second toning shell 204 and the individual image pixel locations is the second development difference of potential VD2, less a difference of potential of the first toner VFT at the individual engine pixel location and the image modulated difference of potential VEPL at the individual engine pixel location. The second development difference of potential VD2 is greater than VD1 in amounts that can range, for example, and without limitation, between about 25 and 75 percent of VD1 (step 246).

Second toner 208 having a charge of the first polarity is positioned so that the second net development potential VNET2 electrostatically urges second toner 208 to deposit on the engine pixel locations to form a first toner image 25 having first toner 158 at each picture element location in amounts that are modulated by the second net development potential VNET2 (step 248).

When the second toner 208 is presented, the second development difference of potential VD2 is greater than the first development difference of potential VD1 but less than an initial difference of potential VI on the primary imaging member 112. This causes at least a first amount of second toner 208 to deposit on individual engine pixel locations having the first toner 158 according to a difference of potential between first development potential VD1 and second development potential VD2 and to provide a second amount of second toner 208 at individual pixel locations having the first toner 158 according to the second net difference of potential VNET2 between second development difference of potential VD2, the potential VFT of any first toner 158 at an individual engine pixel location and the image modulated potential VEPL at the individual engine pixel locations. Accordingly when second net development difference of potential VNET2 increases the amount of second toner 208 increases.

However, since second development difference of potential VD2 is not greater than VI, no second toner 208 deposits on portions of primary imaging member 112 that are unexposed during writing and that therefore have the initial charge VI. Thus, using the method of FIG. 6, it is possible to provide first toner 158 whenever image modulated second toner 208 is developed on a receiver without necessarily requiring that all engine pixel locations on the receiver also receive the first toner 158.

Figure 8A:
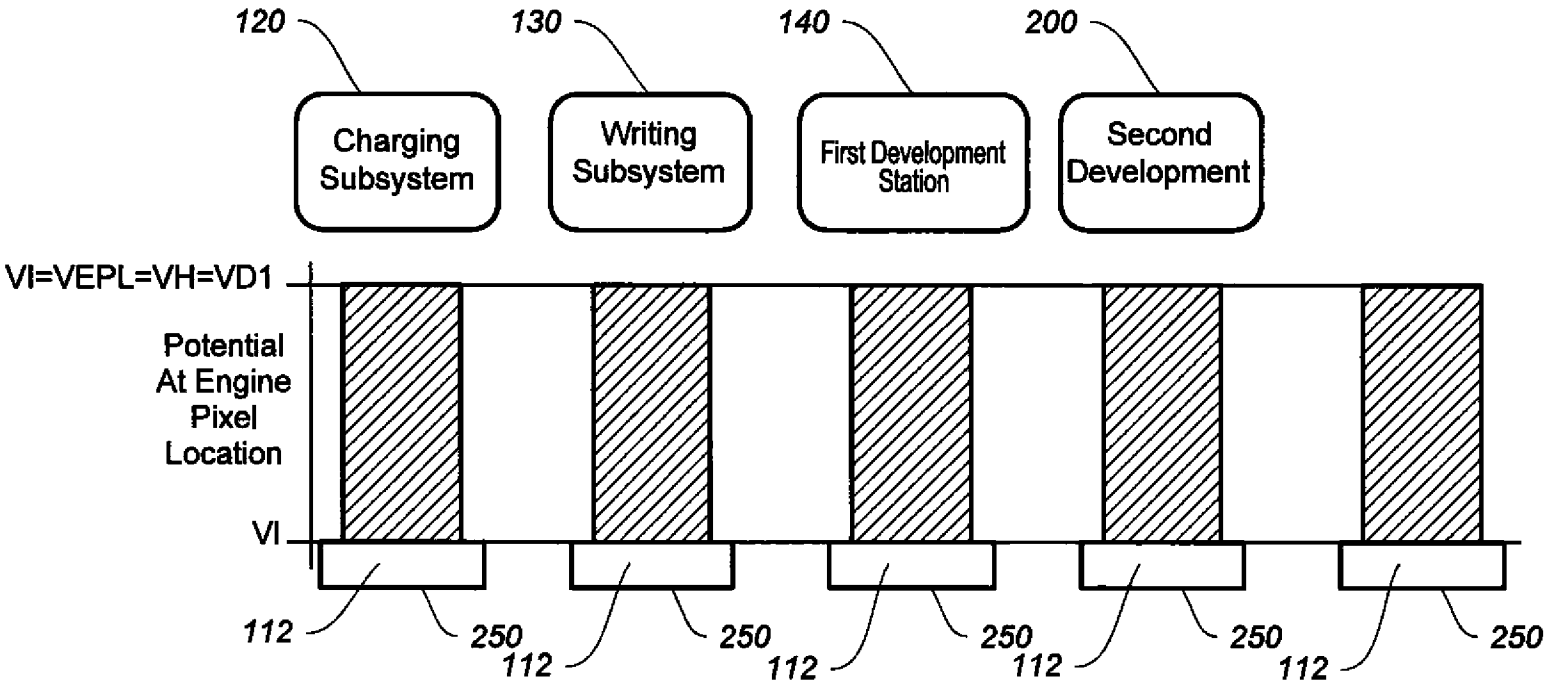
FIGS. 8A-8D illustrate an example of a spectrum of different outcomes that can be made possible using the methods described herein.

An example of a spectrum of different outcomes that are possible using the methods described herein are illustrated generally in FIGS. 8A-8D. As is illustrated in FIG. 8A, when the image modulated potential VEPL at engine pixel location 250 is at a first level that is at the initial difference of potential VI the first development difference of potential VD1 is not greater than initial difference of potential VI, and there is no net first development difference of potential between first development station 140 and engine pixel location 250. Similarly, because in this example, the second development difference of potential VD2 not greater than the initial difference of potential VI, there is no net second development difference potential VNET2 and no development of second toner 208 at engine pixel location 250 having=the first image modulated difference of potential.

Figure 8B:
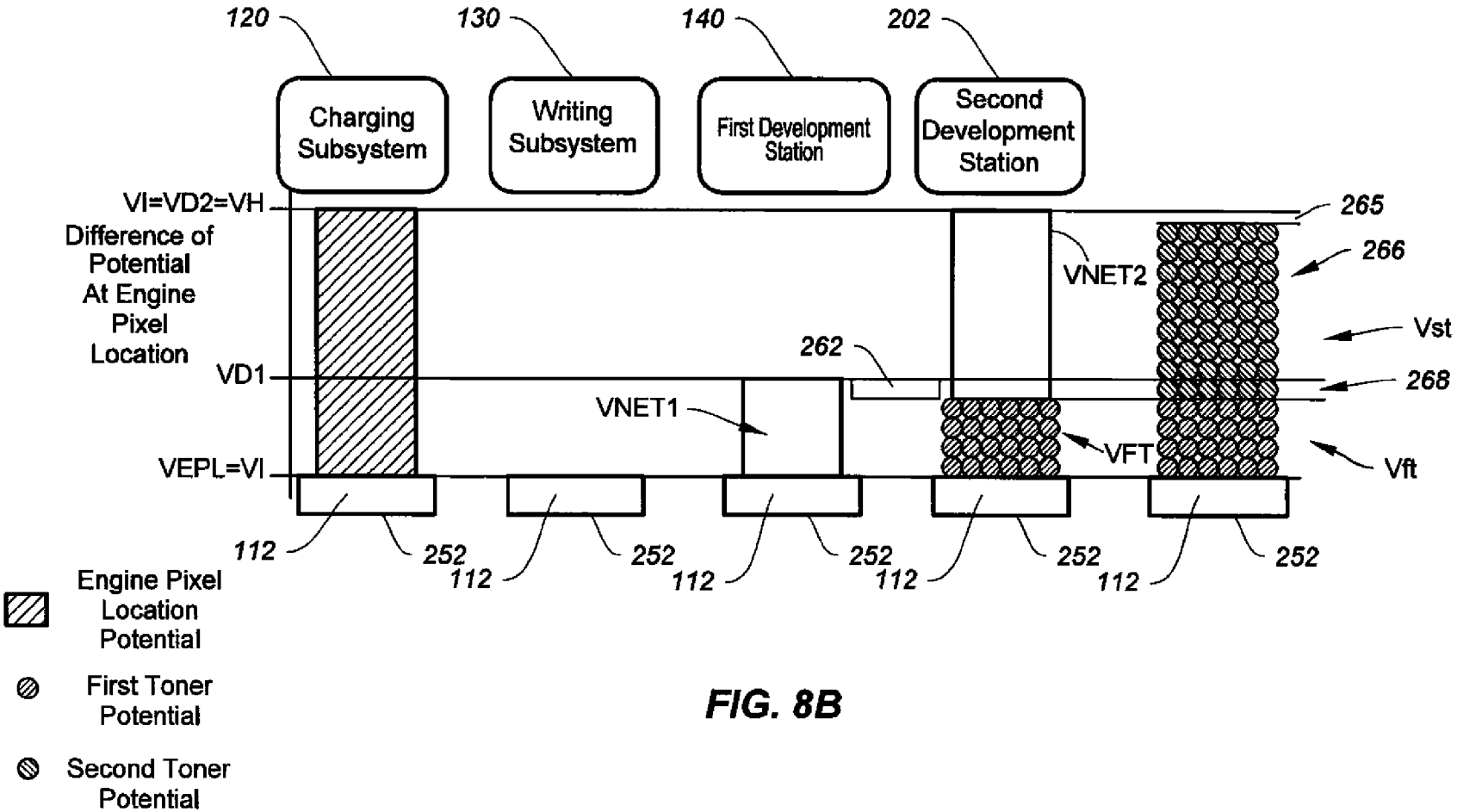

FIG. 8B illustrates the operation of the method of FIGS. 6A and 6B at a second image modulated difference of potential at another engine pixel location 252. As is illustrated here, first toner 158 deposits at engine pixel location 252 having the second image modulated difference of potential until an amount of the charged first toner 158 deposited reaches a first toner potential VFT that is determined by the first net difference of potential VNET1 between first development difference of potential VD1 and the second image modulated difference of potential which here is at the lower voltage VL which is illustrated as ground and less a first development shortfall 262 that arises due to development efficiency being less than unity.

As is further shown in FIG. 8B, after second development of an engine pixel location 252 has a total potential determined by the second image modulated difference of potential and an amount of first toner 158 that creates a first toner difference of potential VFT of the first development difference of potential VD1, also has an amount of second toner 208 deposited that reaches a difference of potential of second toner VST that is at a net second development difference of potential VNET2 of the second development difference of potential VD2 less the first toner difference of potential VFT and less a second development shortfall 272 that arises due to development efficiency being less than unity.

Figure 8C:
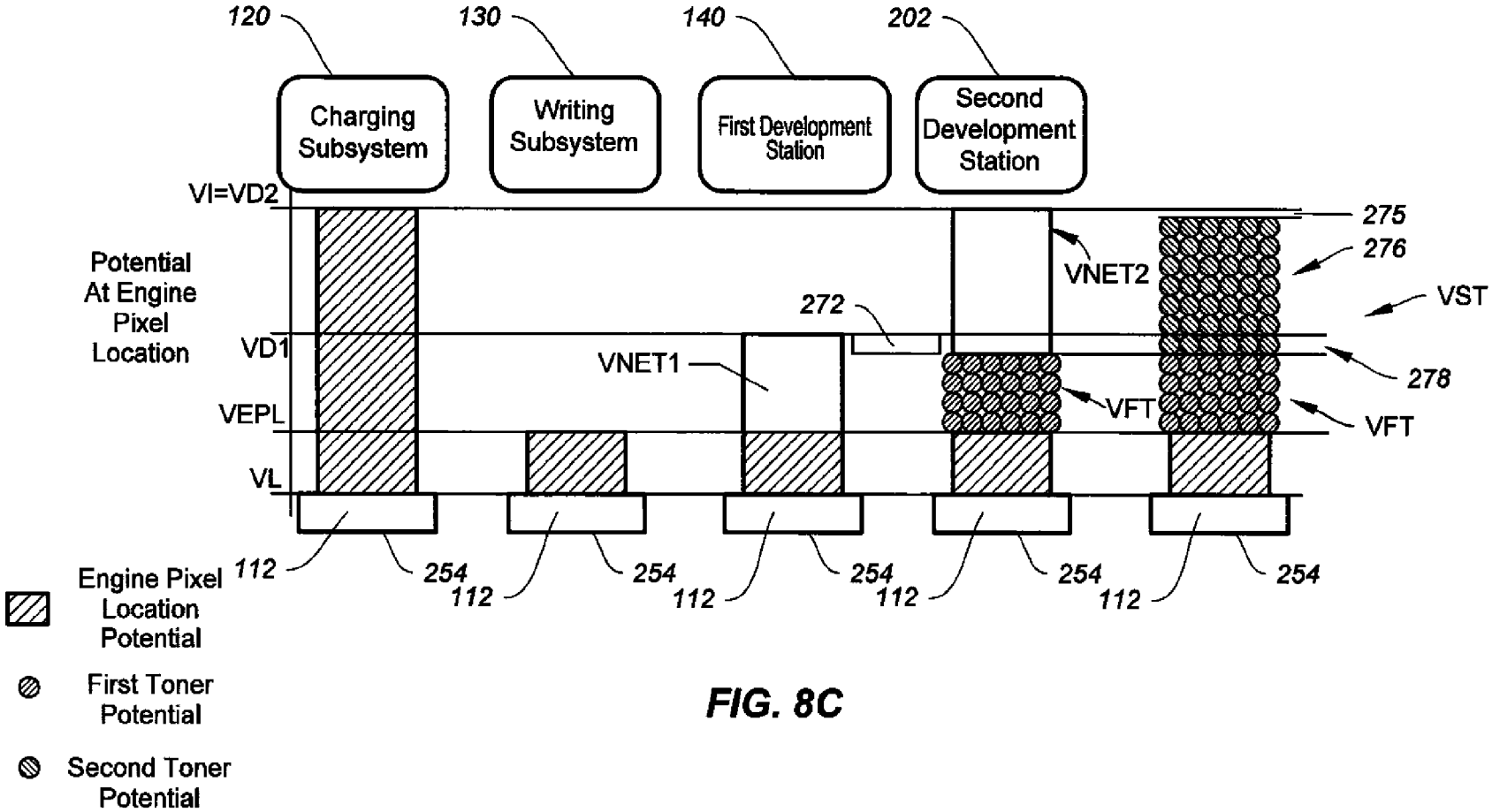

FIG. 8C illustrates the operation of the method of FIGS. 6A and 6B at an engine pixel location 254 that has a third image modulated difference of potential that is within first toner development range 194. In this example, first toner 158 deposits at engine pixel location 254 until the first toner 158 at engine pixel location 254 reaches a first toner difference of potential VFT that is generally the same as the first net development difference of potential VNET1 of first development difference of potential VD1 less the third image modulated difference of potential VEPL at engine pixel location 254. As is further shown in FIG. 8C, second development at engine pixel location 254 provides a net second development difference of potential VNET2 of the second development difference of potential VD2 less the first toner potential VFT, and less the image modulated potential VEPL at engine pixel location 254 and less any development shortfall 275 that arises where the development efficiency of the second development step is less than unity. Thus, while image modulated development of first toner 158 occurs for image modulated differences of potential in the first range 194, second toner 208 is not image modulated by variations in the image modulated difference of potential within this range.

Figure 8D:
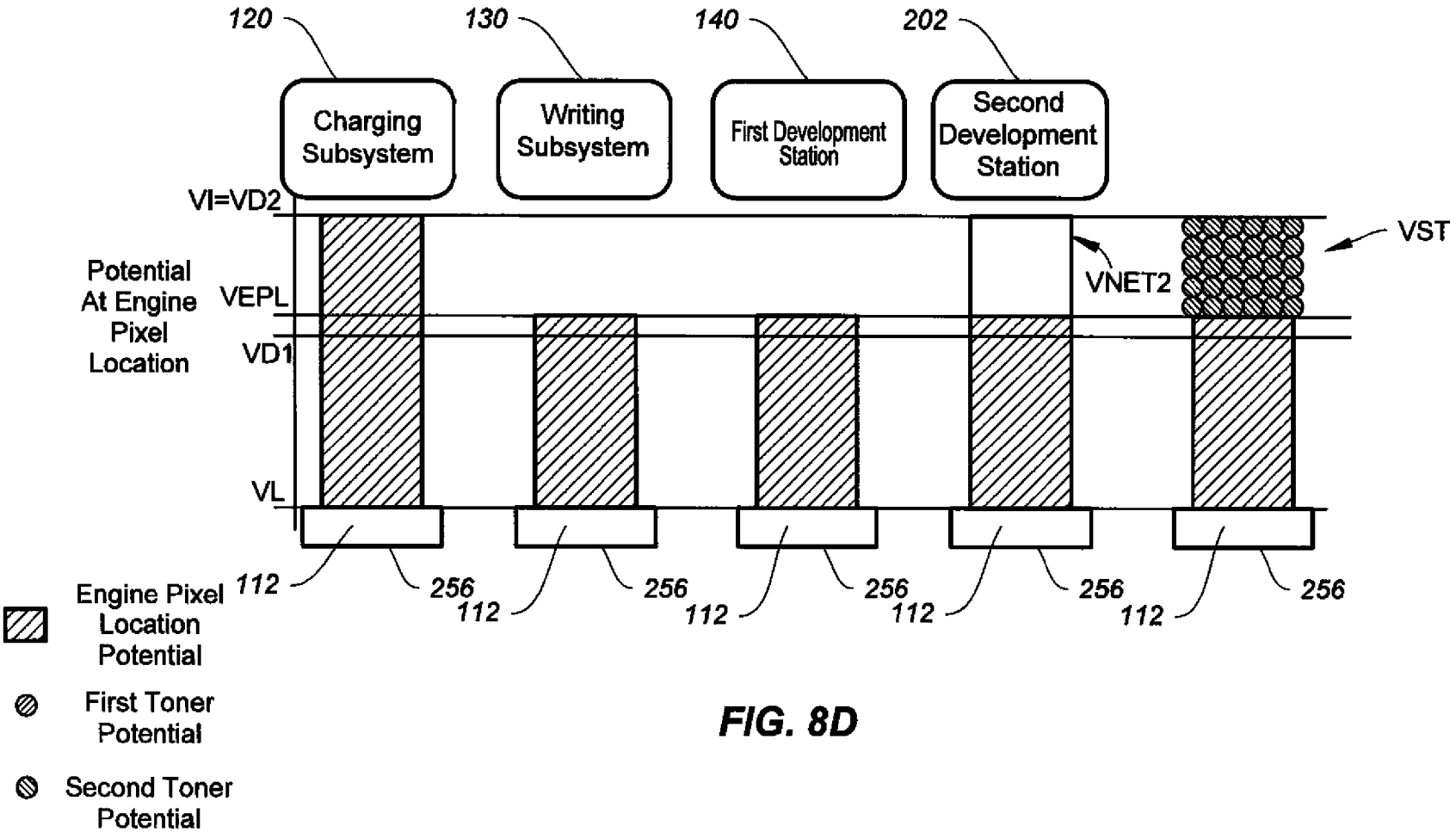

Further, as is shown in FIG. 8D, when an image modulated potential VEPL that is within second range 196 is provided at an engine pixel location 256 there is no net first development potential VNET1 and no first toner 158 is developed. However, there is a second net development difference of potential VNET2 that is determined according to the difference between the second development difference of potential VD2 and the image modulated difference of potential at engine pixel location 256. This allows a range of image modulated development of second toner 208 when the image modulated difference of potential VEPL at an engine pixel location 256 is between the first development difference of potential VD1 and the second development difference of potential VD2.

As is discussed generally above, in application the amount of first toner developed in response to a first net development difference of potential VNET1 can be less than that required to provide a first toner potential VFT of less than the first net development difference of potential VNET1 toner difference of potential and that second toner difference of potential VNET can develop in amounts that create a second toner difference of potential VST that is less than the second net development difference of potential VNET2. To the extent that such development efficiencies exist in a predictable manner the effects of development efficiencies can be considered in processes of identifying the overall range of image modulated differences of potential for first toner 158 and second toner 24, determining the first toner development range 194, determining the second toner development range 196, and determining image modulated differences of potential within the first range 194 for developing first toner 158 and determining image modulated differences of potential within the second range.

FIG. 9 provides one model of a toner delivery curve for toner amounts that could be provided in response to a single image modulated difference of potential at an engine pixel location in accordance with the methods and apparatuses described herein. As can be seen in FIG. 9, three ranges of outcomes are possible. In range A no first toner 158 or second toner 208 would be deposited on the primary imaging member, while in range B second toner 208 is deposited in an amount that monotonically increases with increasing differences of potential between VD2 to a higher amount and the image modulated difference of potential at an engine pixel location VEPL. In range C the image modulated difference of potential; VEPL is less than a first development difference of potential VD1 so that the higher amount of second toner 208 is deposited on the primary imaging member of first. However, at all image modulated differences of potential within this range the amount of second toner 208, this amount remains fixed at the higher level. In contrast, first toner 158 is deposited in an amount that that monotonically increases with increasing difference of potential between VD1 and the image modulated difference of potential VEPL. Thus, a single engine pixel location can have, in response to a single image modulated difference of potential, no toner (range A), a range of second toner amounts 208 (range B) and a combination of a high amount of second toner 208 is with any of a variable range of first toner 158 (range C).

What is claimed is:

1. A method for printing, the method comprising:

charging individual engine pixel locations of a primary imaging member with an image modulated difference of potential of a first polarity between a higher difference of potential and a lower difference of potential relative to a ground;

establishing a first development difference of potential of the first polarity between the higher difference of potential and the lower difference of potential at a first development station to form a first net development difference of potential between the first development station and the individual engine pixel locations on the primary imaging member, with the first net development potential being the first development difference of potential less any image modulated difference of potential at the engine pixel location;

positioning a first toner charged at a second polarity that is the opposite of the first polarity at the first development station, such that the first toner is electrostatically urged to deposit in the individual engine pixel locations according to the first net development difference of potential for the individual engine pixel locations;

establishing a second development difference of potential of the first polarity at a second development station to form a second net development difference of potential between the second development station and the individual engine pixel locations on the primary imaging member, with the second net development difference of potential being the second development difference of potential less any image modulated difference of potential at the individual engine pixel location and less any difference of potential relative to ground of any first toner at the individual engine pixel location; and positioning a second toner of the second polarity at the second development station such that the second toner is electrostatically urged by the second net development difference of potential to deposit on the individual engine pixel locations having first toner;

wherein the second development difference of potential is greater than the first development difference of potential to cause the second toner to deposit on the individual engine pixel locations, having the first toner, in an amount that increases according to the second net development difference of potential, and wherein the first development difference of potential is at a level that is determined to provide a first range of modulated first toner amounts in response to image modulated differences of potential that are in a first range ending at the first development difference of potential, and that provides a second range of modulated second toner amounts in response to image modulated differences of potential that are in a second range beginning at the first development difference of potential.

2. The method of claim 1, wherein the first development difference of potential is determined based upon a range of densities that are required of the first toner and the second toner to form a print.

3. The method of claim 1, wherein the total range of image modulated differences of potential provided for developing the first range of image modulated differences of potential and the second range of image modulated difference of potential is greater than a range of image modulated differences of potential used to develop a single toner.

4. The method of claim 3 wherein the range of image modulated differences of potential provided for developing the first range of image modulated differences of potential and the second range of image modulated difference of potential is no greater than the single toner range of image modulated difference of potential, and wherein determination of the image modulation for the first toner and the second toner is adjusted to within the first range and the second range.

5. The method of claim 1, wherein the first toner comprises a plurality of different toner particles.

6. The method of claim 1, wherein the second toner is clear when fused and the first toner is not clear.

7. The method of claim 1, wherein the second toner has toner particles that are a diameter that is different than toner particles of the first toner.

8. The method of claim 1, wherein the second toner has toner particles that are formed from a different material composition than toner particles in the first toner.

9. The method of claim 1, wherein the second toner has a different glass transition temperature than the first toner.

10. The method of claim 1, wherein the second toner has a lower glass transition temperature than the first toner.

11. The method of claim 1, further comprising the step of transferring the first toner and the second toner onto an intermediate transfer member and then transferring the first toner and the second toner from the intermediate transfer member onto a receiver.

12. The method of claim 1, wherein the first toner, the second toner and the primary imaging member are negatively charged.

13. The method of claim 1, wherein a difference of potential between the second development difference of potential and the first development difference of potential is at least 25 percent of the first development potential.

14. The method of claim 1, wherein the individual engine pixel locations on the primary imaging member are charged by creating an initial difference of potential relative to ground at the individual engine pixel locations on a photoreceptor of the primary imaging member, and exposing the individual engine pixel locations to light to discharge individual engine pixel locations to an extent that is generally proportional to density information in an image being printed by printing module image while leaving other engine pixel locations at the initial difference of potential.

15. The method of claim 14, wherein the second development difference of potential is greater than the initial difference of potential such that second toner is applied to individual engine pixel locations on which no first toner is recorded according to the difference of potential between the second development difference of potential and the initial difference of potential.

16. The method of claim 1, wherein the first toner comprises a toner of a first color having a first hue and wherein the second toner comprises a toner having the first color and a second different hue.

17. The method of claim 1, wherein the first toner comprises a toner of a first viscosity and the second toner comprises a toner of a second viscosity that is different from the first viscosity.

18. The method of claim 1, wherein the first toner has first color characteristics and the second toner has different second color characteristics.

19. The method of claim 1, wherein the individual engine pixel locations that are to have a first toner without the second toner are charged with a difference of potential at or less than the first development potential.

20. The method of claim 1, wherein the individual engine pixel locations that are to have a first toner without the second toner developed thereon are positioned so that the first toner will be transferred onto a receiver at locations that correspond to locations where other toners are provided when all the toner forming the image has been transferred to the receiver.

21. The method of claim 1, wherein the electrostatic forces that urge transfer of an amount of the second toner to an individual engine pixel location automatically register the second toner with the individual engine pixel location.

* * * * *